367-93 SR

9/15/81 OR 4,290,126

United States Patent [19]

McFadyen et al.

[11] 4,290,126

[45] Sep. 15, 1981

[54] ULTRASONIC INTRUSION ALARM SYSTEM

[75] Inventors: Robert J. McFadyen, Syracuse, N.Y.; John F. Zeigler, III, Newtown, Conn.

[73] Assignee: General Electric Company, Syracuse, N.Y.

[21] Appl. No.: 93,100

[22] Filed: Nov. 9, 1979

[51] Int. Cl.[3] ..... G08B 13/16

[52] U.S. Cl. ..... 367/93

[58] Field of Search ..... 367/93, 901; 340/554, 340/552

[56] References Cited

U.S. PATENT DOCUMENTS

| | | | |
|---|---|---|---|
| 3,406,385 | 10/1968 | Lerner | 367/93 |
| 3,474,400 | 10/1969 | Auer, Jr. et al. | 367/93 |
| 3,781,772 | 12/1973 | Inoue et al. | 367/93 |
| 3,922,629 | 11/1975 | Hayakana | 367/93 |

*Primary Examiner*—Glen R. Swann, III

*Attorney, Agent, or Firm*—Richard V. Lang; Carl W. Baker

[57] ABSTRACT

An ultrasonic intrusion alarm system of the pulse-echo type transmits pulsed signals which are reflected by a reference surface. The resulting reference received pulsed signals appear as corresponding signals at the output of the system's receiver, which is gated on in coincidence with the arrival of said reference signals and is gated off at essentially all other times for minimum power consumption, the output signal state of said receiver being employed to cause the generation of an alarm signal upon the occurrence of an intrusion. The receiver includes an AGC amplifier network which exhibits a threshold voltage level that is a function of the signal strength of said reference signals which level is compared with the amplified received signals whereby said alarm is generated when said threshold level fails to be exceeded, such as due to an interruption of said signals.

19 Claims, 15 Drawing Figures

FIG. 6A
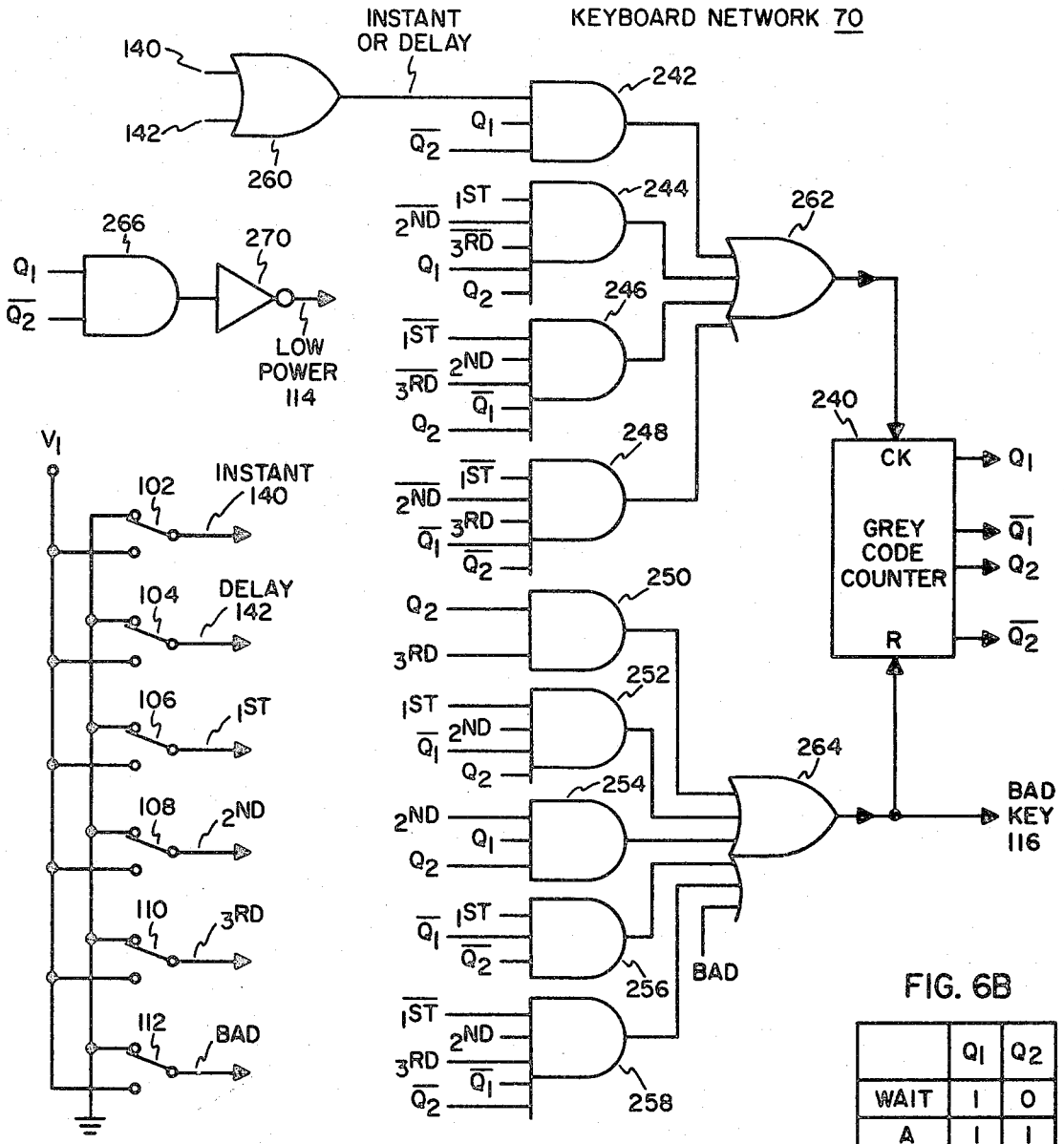
FIG. 6B
| | $Q_1$ | $Q_2$ |
|---|---|---|
| WAIT | 1 | 0 |
| A | 1 | 1 |
| B | 0 | 1 |
| C | 0 | 0 |
FIG. 7
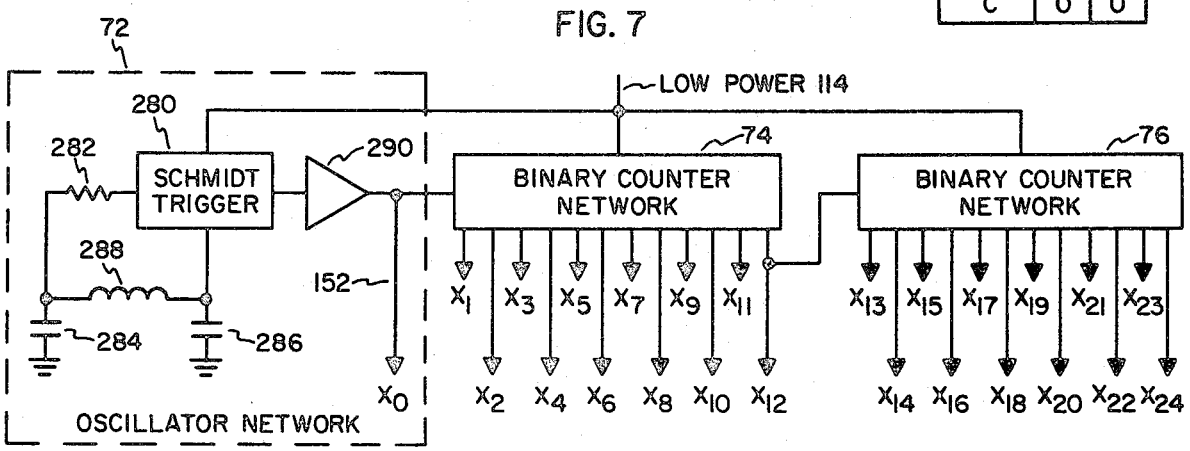

ULTRASONIC INTRUSION ALARM SYSTEM

BACKGROUND OF THE INVENTION

The invention relates in general to intrusion alarm systems, and more particularly to portable, ultrasonic, pulse-echo type systems that generate an alarm signal upon the occurrence of an intrusion within a protected area.

Intrusion alarms of numerous types have been utilized for detecting the presence of an intruder within a protected area. In one known intrusion alarm system operating on the Doppler principle, a transmitter and receiver are located in or adjacent to an area to be protected. A continuous wave of ultrasonic energy is broadcast by the transmitter at a predetermined frequency, reflected by stationary objects in the protected area and then sensed by the receiver. Insofar as the reflected energy occurs at the same frequency, the apparatus determines that an intruding condition does not exist and no alarm is sounded. The passage or movement of an intruder through the protected area, however, causes a variation in the frequency of the reflected energy which variation is sensed and an alarm is sounded. This form of intrusion alarm system is recognized to be substantially susceptible to false alarms.

In another intrusion alarm system, pulse-echo techniques are employed wherein a pulsed signal of acoustical energy is transmitted by a transducer and the occurrence of a pulse of reflected acoustical energy within a predetermined time interval is indicative of the presence of an object in an area being examined. By transmitting pulses of acoustical energy in a narrow beam toward a reference surface and detecting reflections of the pulsed acoustical energy, any activities or environmental changes which alter a reflection from the reference surface are detected and an alarm is sounded. The pulse-echo intrusion alarm systems have been found to be of improved reliability and less susceptible to false alarms than systems operating on the Doppler principle. In addition, they lend themselves to a relatively low cost, mass production fabrication. Two such systems are disclosed in allowed copending application for U.S. Letters Patent entitled, "Improved Detection Method and Apparatus", inventor R. Salem, Ser. No. 959,105 filed Nov. 9, 1978 and U.S. Pat. No. 4,229,811, issued to R. Salem for "Improved Detection Method and Apparatus" on Oct. 21, 1980, both assigned to the present assignee.

SUMMARY OF THE INVENTION

Accordingly, it is an object of the present invention to provide a novel and improved pulse-echo intrusion alarm system that retains the above noted advantages of such type systems and which further operates with a minimum of power consumption.

A related object of the invention is to provide such intrusion alarm system in which the operating life of the system's battery power supply is significantly lengthened.

Another object of the invention is to provide a novel intrusion alarm system as described which provides an improved system calibration for a more reliable operation.

A further object of the invention is to provide a novel and improved intrusion alarm system as described whose operation will be automatically compensated for slowly varying environmental conditions such as temperature and humidity.

Yet another object of the invention is to provide a novel and improved intrusion alarm system as described whose operation will be substantially unaffected by certain abrupt signal variations such as may be due to noise.

These and other objects of the invention are accomplished, in accordance with one aspect of the invention, in an intrusion alarm system in which transmitted pulsed signals are reflected by one or more objects within a protected area, one of which forms a reference surface, with the resulting received pulsed signals from said reference surface employed to provide an indication of an intrusion within said protected area, comprising: transmitter means for periodically transmitting the transmitted pulsed signals, gate controlled receiver means, responsive to the received pulsed signals, for generating output signals that correspond to said received pulsed signals, a first digital circuit for calculating the travel time of pulsed signals between said transmitter means and receiver means and for generating first control signals as a function of said travel time of received pulsed signals, a second digital circuit, responsive to said first control signals, for periodically gating on said receiver means during brief periods that coincide with the arrival of uninterrupted reference received pulsed signals that are reflected by said reference surface, whereby said output signals are generated only upon the gated on operation of said receiver means, and a third digital circuit, responsive to the output signal state of said receiver means during said brief periods, for generating an alarm signal that is indicative of an intrusion in the absence of said output signals and for preventing the generation of said alarm signal in the presence of said output signals.

In accordance with a further aspect of the invention, the system includes mode circuitry for initially placing said system in a calibration mode composed of alternating sample and test cycles within which said system is automatically calibrated to operate with said reference surface and said alarm signal is prevented from being generated, for transitioning said system into an arm mode at the conclusion of said calibration mode and for transitioning said system into an alarm mode upon the occurrence of an intrusion within which said alarm signal is generated.

In accordance with yet a further aspect of the invention, the receiver means comprises an AGC amplifier network exhibiting a slowly varying AGC voltage level that is a function of the signal strength of the received pulsed signals for controlling the gain of said amplifier network and also exhibiting a threshold voltage level that is related to and slightly below said AGC voltage level, the amplified received signals being compared with the threshold voltage level for generating said output signals only when said threshold level is exceeded, whereby slow changes in signal strength of the received pulsed signals are automatically compensated for by amplifier gain adjustment and a corresponding adjustment of the threshold voltage level, and small instantaneous variations in signal strength continue to provide amplified signals that exceed the threshold voltage level.

BRIEF DESCRIPTION OF THE DRAWINGS

While the specification concludes with the claims which particularly point out and distinctly claim that subject matter which is regarded as inventive, it is believed the invention will be more clearly understood when considering the following detailed description taken in connection with the accompanying figures of the drawings, in which:

FIG. 6A is schematic logic diagram of the keyboard network of the present system;

FIG. 6B is a logic table useful in describing the operation of the keyboard network of FIG. 6A;

FIG. 7 is a schematic logic diagram of the oscillator and binary counter networks of the present system;

DESCRIPTION OF A PREFERRED EMBODIMENT

Figure 1:
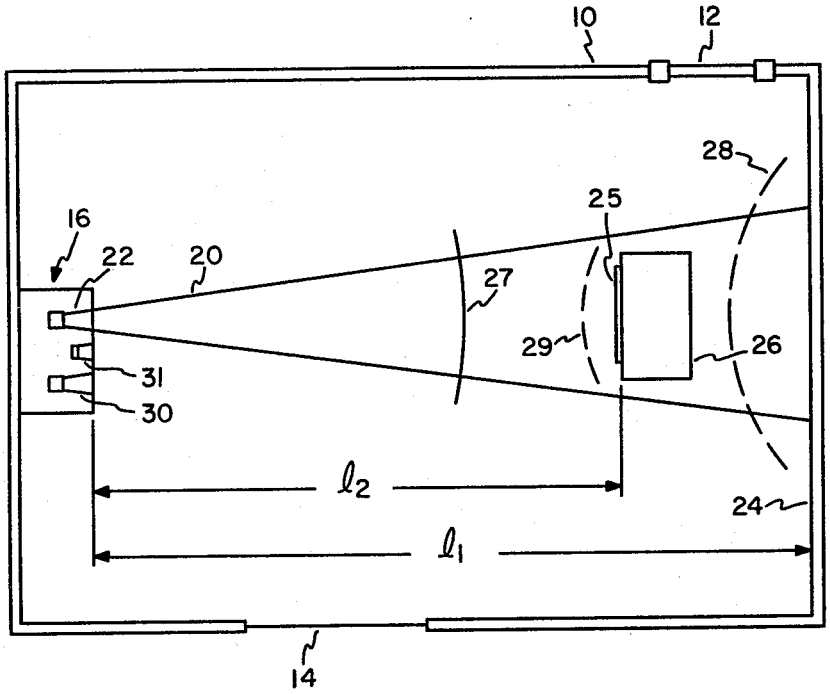
FIG. 1 is a schematic diagram in plan view of an intrusion alarm system, in accordance with the present invention, in an operative setting within an area to be protected.

An intrusion alarm system of the pulse-echo type for establishing intrusion detection, in accordance with this invention, is generally illustrated in an operative setting in FIG. 1, which is a plan view of an area to be protected. The area comprises a room 10 having various means of ingress and egress, such as a door 12 and a window 14. The apparatus of the invention, referenced generally as 16, is positioned at a convenient location and elevation within the protected area. A generally conically shaped narrow beam 20 of acoustical energy pulses is projected from a transmitting transducer 22 of the apparatus 16 toward a primary target or reference surface comprising a wall 24 and toward a secondary target surface comprising the flat surface 25 of a body 26 which, for example, comprises a television receiver that is spaced from the larger wall surface. Beam 20 is generally conically shaped and the projected acoustical energy pulses represented by the curved wave from 27 impinges in part upon the primary target surface 24 at the greater distance $l_1$ and in part upon the secondary target surface 25 which is at a shorter distance $l_2$. Thus, a portion of the projected acoustical energy will be reflected from the wall surface 24 represented by the dashed curve 28, and a portion from the surface 25 represented by the dashed curve 29.

Figure 2:
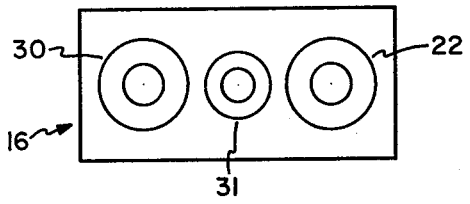
FIG. 2 is an enlarged side elevational view of the intrusion alarm apparatus of FIG. 1.

Reflected acoustical energy pulses are sensed by a receiving transducer 30 of the apparatus 16. Acoustical energy incident on receiving transducer 30 causes electrical signals to be generated which are representative of the received energy. The transmitting and receiving transducers 22 and 30, respectively, and an alarm horn 31 are mounted in juxtaposed relationship in a housing member 32 of the apparatus 16, shown in an elevational view in FIG. 2. Alternatively, the transmitting and receiving transducers can be positioned at spaced apart locations, insofar as the receiver is oriented for receiving reflected energy.

The intrusion alarm operates on the principle of transmitting and receiving a reflected ultrasonic pulsed signal and where interruption of the established beam is used for detection of intrusion. Summarily, a range gate window is established during the time the reflected signal from the primary target surface is normally received, which is done by briefly gating the receiver on. Should the reflected signal fail to appear within the range gate window due to interruption of the beam, an audible alarm is sounded. In the exemplary embodiment under consideration, the ultrasonic signal is pulsed to consist of 8 cycle bursts of 31 kHz at a pulse repetition rate of 15 Hz. The 15 Hz rate allows some 66 milliseconds between transmitted pulses and since the speed of sound is normally 1127 ft/sec, the allowable one-way distance for the reflected pulse is between about 30 and 40 feet. At a lower repetition frequency the system can be operated out to the farther range.

There are four functional modes which define the system operation, viz., wait, calibrate, arm and alarm modes. "Wait" is the off or non-use mode. To start the system the user pushes either the instant or delay button. Instant will set the system to alarm immediately, while delay will provide a several second delay before the start of the alarm after intrusion. Once started, the system is, for a short time, in the calibrate mode. During this time, several things are occurring. The system uses several seconds of this interval to find the last strong echo target signal and to standardize its amplitude at the output of the receiver circuitry. Once this reference echo target signal is established, a coincident in time receiver gating pulse is generated which range gates the receiver on and off. The logic system, on alternate cycles of the 15 Hertz pulse repetition frequency, first automatically measures the time of occurrence of the reference echo target signal and on the next cycle determines if the time of occurrence is within the established range gate window. If the reference target signal has shifted, the device will emit an audible beep. This allows the user to establish that the system is calibrating properly on the intended reflecting surface by momentarily interrupting the beam. After transitioning to the arm mode, the system continues to operate on reference target signal but now the range gate window is permanently locked around the time of occurrence of this signal, on each cycle of the 15 Hz pulse repetition frequency. The presence of the reference target signal within the range gate indicates that the ultrasonic pulse is reaching and returning from the reference target surface 24 with about the same amplitude as when in the calibrate mode. As sudden intrusion into the beam will reflect the acoustic energy at a different time relative to the position of the range gate or will substantially attenuate said energy. Since the system's AGC amplifier is designed to have a slow response, the standardizing output pulses will suddenly drop and the absence of a detected target signal during the range gate window transitions the system to the alarm mode.

The system will alarm immediately if the instant button were used to start the system or will delay several seconds if the delay button were used. If not turned off, the alarm will sound with relatively high volume for several minutes, after which the system automatically re-enters the calibrate mode in preparation to re-arm.

Among other features of the system, recalibration or re-centering of the range gate on the reference echo target signal is performed every four and one-half minutes. This is done on the fly and requires only one period of the 15 Hz repetition frequency for recalibration. In addition, slow changes in echo target signal amplitude will be accommodated by the AGC system, should they occur between recalibration cycles. When the battery voltage degrades to a predetermined value, typically from a nominal value of 9 v to approximately 7.5 v, a low battery alarm signal is actuated. This sound is a low level beep.

The user interfaces the intrusion alarm through several push buttons. Two are designated for the instant and delay modes while the others are for inputting a three digit turn-off code. Entry of an incorrect code sequence or a "bad code" immediately sets off the alarm once the system has reached the armed state.

Figure 3:
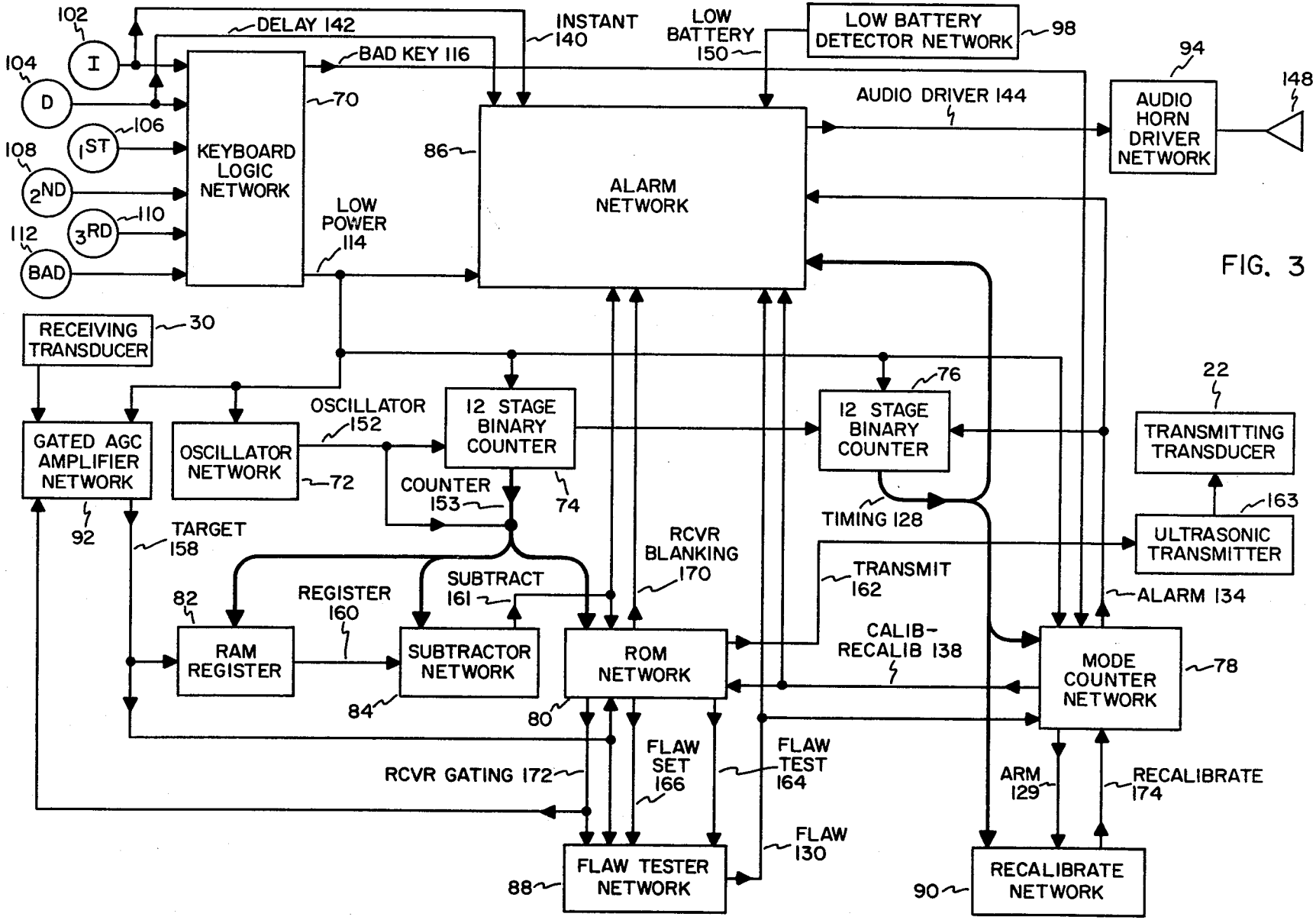
FIG. 3 is a block diagram of the present intrusion alarm system.

With reference to FIG. 3, there is illustrated a block diagram of the intrusion alarm system of the present invention, including the following digital components: a keyboard logic network 70, an oscillator network 72, binary counters 74 and 76, a mode counter network 78, ROM (Read Only Memory) network 80, RAM (Random Access Memory) register 82, subtractor network 84, alarm network 86, flaw tester network 88, and recalibrate network 90; and the following linear components: a receiver gated AGC amplifier network 92, an audio horn driver network 94 and a low battery detector network 98. The digital components provide binary outputs of two discrete voltage levels. One is normally at ground and the other at a finite positive voltage, nominally the supply voltage, which correspond logically to a binary "0" and "1", respectively.

Keyboard logic network 70 is operated by a plurality of push buttons 102, 104, 106, 108, 110 and 112. Actuation of either push button 102, referred to as the on-instant button, or push button 104, referred to as the on-delay button, serves to start the system. The on-instant button provides an operation whereby the audible alarm signal is set off immediately upon the occurrence of an intrusion. The on-delay button provides sounding of the audible alarm signal with a delay of several seconds after the occurrence of an intrusion. This allows the user to turn the system off upon re-entering the protected area before the alarm can sound. Off push buttons 106, 108 and 110 are employed to turn the system off when actuated in a predetermined order, which order can be selectively encoded into the keyboard logic network such as through switchable wired interconnections of said buttons. Push button 112, referred to as the bad key push button, of which there can be one or several, will trigger the audible alarm signal when depressed as will an improper sequencing of the off push buttons. The keyboard logic network 70 provides two outputs, a Low Power output 114 and a Bad Key output 116. Low Power output 114 is coupled to oscillator network 72, first 12 stage binary counter 74, second 12 stage binary counter 76, mode counter network 78, alarm network 86 and gated AGC amplifier network 92 for supplying a relatively limited amount of continuous power to these components, which includes the supply of a low bias current to amplifier network 92. It is noted that this continuous power represents a small fraction of the total power consumed when the receiver AGC amplifier network 92 is gated "on", which is for but brief periods of operation as will be further described. Bad Key output 116 is coupled to mode counter network 78 to be employed in its functioning.

The keyboard logic network 70 is normally in a WAIT state, having three other states referred to as A, B and C states. The WAIT state is initiated upon initial energization of the system, such as insertion of the system's batteries. In this state, a disabling signal, corresponding to a binary 0, is present at Low Power output 114 for keeping power removed from the above noted system components. Upon actuation of either the on-instant button 102 or the on-delay button 104, the keyboard logic network transitions into its A state and an enabling signal, corresponding to a binary 1, is present at Low Power output 114 to supply power to this system for so long as the keyboard network remains out of its WAIT state. The system is turned off and returned to the WAIT state by the properly ordered actuation of off buttons 106, 108 and 110 which sequence the keyboard network into its B state, C state and WAIT state, respectively. An improperly ordered actuation of the off buttons or actuation of the bad key button 112 provides a signal at Bad Key output 116 which, as will be seen, functions to sound the audible alarm.

The mode counter network 78 provides three modes of system operation, a calibrate mode, an arm mode and an alarm mode. The calibrate mode extends over a brief period during which the system is automatically calibrated, i.e., the system parameters are established for a given target orientation including primarily the successive acquisition and testing of target range. In the exemplary embodiment of the invention under consideration the calibrated operation is for about 34 seconds. Following the calibrate mode and in response to a Timing output 128 from binary counter 76, which comprise a bundle of different timing functions, the mode counter is transitioned into the arm mode. During the arm mode, the system is operated in a range gated manner, as will be described in detail, and is sensitive to an intrusion, which is the interruption of the ultrasonic beam that causes the echo target signal from the principal reference surface to be substantially attenuated or erased. Also during the arm mode, an Arm output 129 is applied to recalibrate network 90. Upon the occurrence of an intrusion, and in response primarily to a Target output 158 from gated AGC amplifier network 92 which presents a disabling signal at this time corresponding to the absence of a detected target signal, a flaw signal is generated at Flaw output 130 from flaw tester network 88. In response to Flaw output 130 or Bad Key output 116, the mode counter network transitions into the alarm mode and provides an alarm signal at Alarm output 134. This output is applied to alarm network 86 so as to cause the sounding of a high volume, audible alarm signal for an extended period of time as determined by the Timing output 128, for example, four and one-half minutes. Alarm output 134 is also employed to reset binary counter 76. The mode counter network 78 is then automatically returned to the calibrate mode. Network 78 also provides a Calibrate-Recalibrate output 138 which is supplied to ROM network 80 and alarm network 86 for making these networks responsive to a calibrate or recalibrate operation, as will be further explained.

Alarm network 86 responds to an Instant output 140 from on-instant button or a Delay output 142 from on-delay button 104 and to Alarm output 134 upon the occurrence of an intrusion for providing a signal to an Audio Driver output 144 which is applied to audio horn driver network 94 for sounding the previously mentioned audible alarm signal from an alarm horn 148. Additionally, in response to Instant and Delay outputs 140 and 142 and Timing output 128, the alarm network provides a signal to Audio Driver output 144 so as to generate a first, low volume audio or beep signal from the alarm horn 148. In response to Flaw output 130 and Calibrate-Recalibrate output 138, the alarm network supplies a further signal to output 144 for providing a second beep signal that is employed to give an indication of the proper or improper functioning of the system during the calibrate mode. Finally, alarm network 86 responds to a Low Battery output 150 from low battery detector network 98 for providing a signal at output 144 for producing a third beep signal for indicating a low battery voltage condition.

The Oscillator output 152 of oscillator network 72 and the Counter output 153 of the first 12 stage binary counter 74, which comprises the combined outputs of the individual stages of binary counter 74, are supplied to ROM network 80, RAM register network 82 and subtractor network 84. In response to outputs 152 and 153 and to Target output 158 from gated AGC amplifier network 92, RAM register 82 furnishes a Register output 160, which combines outputs of the individual stages of the RAM register and is applied as a first input to subtractor network 84. Target output 158 causes the count from binary counter 74 to be stored in RAM register network 82 to coincide with the reception of the detected signal from amplifier network 92, Register output 160 represents this stored count, which provides a calculation of travel time of acoustical energy between the transmitting and receiving transducers. Subtractor network 84 operates to subtract the stored count of Register output 160 from the continuous binary count of output 153 applied as a second input to network 84 and provides a signal at Subtract output 161 only when the stored count and binary count are in close approximation, typically within 32 counts of each other. The subtract output signal is thereby a narrow pulse output which is coupled to ROM network 80 for contributing to its operation during the calibrate and arm modes.

In a selective response to Counter output 153 and Oscillator output 152, ROM network 80 provides a signal at a Transmit output 162 that is coupled to an ultrasonic transmitter 163 that may be a conventional circuit for actuating the transmitting transducer 22. In a further selective response to Counter output 153, ROM network 80 provides a Receiver Blanking output 170 to the alarm network 86 for contributing to its beep signal operation. In a still further selective response to Counter output 153, ROM network 80 further provides a Flaw Test output 164 and a Flaw Set output 166 to flaw tester network 88 for contributing to its operation. Finally, in a selective response to Counter output 153 and to subtract output 161, the ROM network supplies a Receiver Gating output 172 to gated AGC amplifier network 92 for range gate controlling its operation, and to flaw tester network 88 for contributing to its operation.

Flaw tester network 88, in response to Target output 158 and Receiver Gating output 172, provides Flaw output 130 which is applied to mode counter network 78 and employed in its operation.

Recalibrate network 90, in response to Timing output 128 from binary counter 76 and to Arm output 129 from mode counter network 78, provides a Recalibrate output 174 that is coupled to the mode counter network for contributing to the generation of the Calibrate-Recalibrate output signal.

Considering the operation of the intrusion alarm system of FIG. 3, the system is in a de-energized condition until started by depressing either the on-instant button 102 or the on-delay button 104. This action also sounds a first, low volume audio or beep signal from horn 148 indicating start of operation. The system is turned off by depressing the off buttons 106, 108, and 110 in a particular encoded sequence. Thus, when the system is not in operation it does not dissipate power other than through small battery leakage currents. It will be assumed the system is started by actuating button 104 which introduces a short time delay after the occurence of an intrusion before the alarm is sounded. In this way the operator can turn the system off upon re-entering the protected area without the audible alarm being sounded. Upon actuation of button 104, the keyboard logic network 70 immediately steps from its WAIT state to its A state, where it will remain until the system is ready to be turned off. Stepping to the A state causes portions of the system to be energized through Low Power output 114. More specifically, all of the digital components and parts of the linear circuitry are energized at this time. The remaining circuitry, including the gain stages and AGC circuit of the gated AGC amplifier network 92, remain de-energized and become energized only in response to a receiver gating signal subsequently generated in the system operation, as will be further described.

Upon starting up, the system is automatically placed in a calibrate mode by the mode counter network 78 and remains in the mode for a sufficient time to perform calibration, which in the example under consideration has been noted to be 34 seconds. After this time, through the action of mode counter 78, the system automatically increments to the arm mode where it remains indefinitely. The occurrence of an intrusion or the incorrect actuation of the off or bad key buttons increments the system into the alarm mode for sounding the audible alarm signal. The system is turned off at any time by the correct operation of the off buttons.

Figure 4:
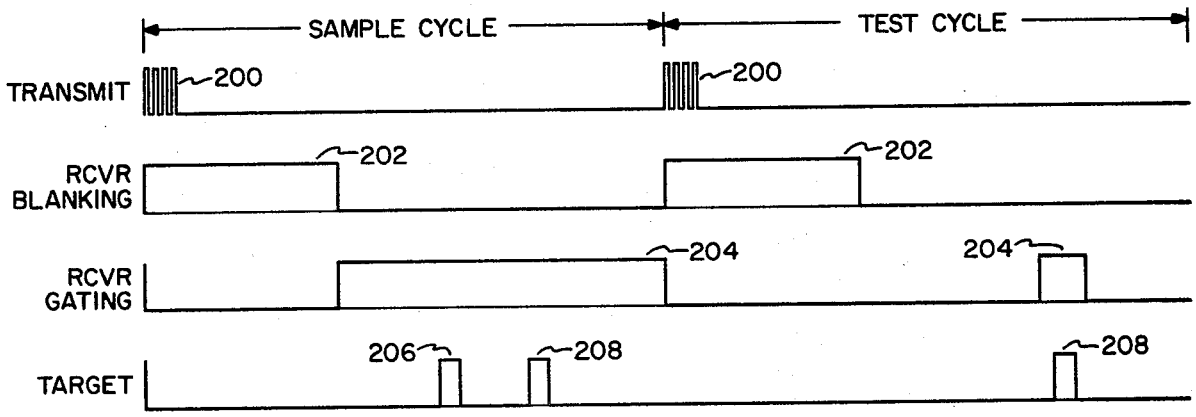
FIG. 4 is a timing diagram useful in describing operation of the present system.

Upon power being applied to oscillator 72 and binary counters 74 and 76, the oscillator generates a continuous train of pulses at a given frequency, which in the example under consideration is 31 KHz. These pulses, which are the system's clock signals from which all system counting and timing functions are derived, are applied to the input of serially connected binary counters 74 and 76. Selectively grouped outputs from the stages of counters 74 and 76 provide various counting and timing functions in the system operation, as will be further explained. Thus, at initiation of the calibrate mode and in response to outputs 152 and 153, a transmitted signal, comprising 8 pulses of the oscillator output, is supplied by ROM network 80 to an ultrasonic transmitter device 163 which includes transmitting transducer 22 for transmitting a corresponding ultrasonic signal toward a target surface or surfaces. For purposes of explanation, it will be assumed that two such target surfaces exist as shown by the surfaces 24 and 25 in FIG. 1. Waveform 200 in the calibrate mode timing diagram of FIG. 4 illustrates this transmitted signal, each burst extending for about 0.26 milliseconds in the present example. For the duration of 128 pulses of the oscillator signal, which correspond to 4.1 milliseconds, there is also generated by ROM network 80 a receiver blanking pulse which ensures that during this time no receiver gating pulse can appear at Receiver Gating output 172, and thus the AGC amplifier network 92 cannot be gate operated until some time after transmission of the ultrasonic pulse. The receiver blanking pulses are shown by the waveform 202 in FIG. 4. For the purpose of illustration, the waveforms of FIG. 4 are not to scale.

During the calibrate mode the system operation is composed of alternating sample and test cycles as illustrated in FIG. 4, in the present example these cycles being each 66.1 milliseconds in length. This is an adequate amount of time for the transmitted ultrasonic signal to be transmitted from the transmitting transducer 22 of apparatus 16 travel to the most remote target surface within a protected area not exceeding dimensions of about 30 feet and be returned to the receiver transducer 30 for processing. The transmitted signal and receiver blanking pulse occur at the initiation of each sample and test cycle, as illustrated by waveforms 200 and 202 in FIG. 4. In addition, a receiver gating pulse, shown by waveform 204 in FIG. 4, is present in each sample cycle as a wide pulse, covering the entire cycle save for the blanking interval, and is present in each test cycle as a narrow pulse that for a calibrated system substantially coincides with the time of reception of each echo target signal reflected from the primary target surface 24.

Upon the transmitted ultrasonic signal being reflected from primary target surface 24 and secondary surface 25, it is returned as two echo target signals displaced in time in accordance with the different path lengths $l_1$ and $l_2$ between the apparatus 16 and the two target surfaces 24 and 25, respectively. During all but the blanking interval of the sample cycle, both echo target signals are amplified, envelope detected and threshold compared by the gated AGC amplifier network 92, which is energized during this entire time by the receiver gating pulse. Upon exceeding a predetermined threshold, the detected target signals appear at Target output 158, illustrated by waveforms 206 and 208 in FIG. 4. These signals are applied to the RAM register 82 and also to the flaw tester network 88 by Target output 158. Application of the first in time target signal 206 will serve to store within register network 82 the count in binary counter 74 occurring at the instant of such application. This storage is short-lived, however, and application of the second in time target signal 208 replaces the first stored signal within register network 82 with the count in binary counter 74 occurring at the instant of application of this target signal. Thus, it is the last echo target signal exceeding said predetermined threshold which becomes the reference echo target signal to determine the stored count in register network 82.

Within subtractor network 84, the continuous count within binary counter 74, termed "X" is subtracted from the stored count in register 82, termed "Y", to generate a subtract signal, termed "W", where, therefore, $W=Y-X$. Subtract signal W, in the form of a narrow pulse having a width corresponding to 64 counts of the binary counter centered on the time of the stored count, is coupled by Subtract output 161 to ROM network 80.

During the test cycle, the Subtract output pulse once again is generated and at this time serves to control the generation of the receiver gating pulse within ROM network 80 as a narrow pulse that is coincident with the subtract pulse which represents a reference parameter for the system. The narrow gating pulse 204, which is about 1 millisecond wide in the present example, serves to gate "on" the AGC amplifier network 92 only during the time when the echo target signal from the reference surface 24 is to be received as determined by the previous sample operation. Echo target signals occurring at other times cannot therefore be received. This is illustrated by the appearance of only target signal 208 in the test cycle of FIG. 4.

If the reference echo target signal and narrow receiver gating pulse are not in coincidence, the alarm network 86 generates a short pulse signal to audio horn driver 94 for sounding a second low volume audio beep signal from horn 148 which indicates the system is not yet calibrated. Alternating sample and test cycles continue during the calibrate mode allowing the system to become properly calibrated whereby the narrow receiver gating pulse is coincident with the reference echo target signal to eliminate the second audio beep signal. Proper calibration of the system may be confirmed by the operator briefly interrupting the ultrasonic beam, such as by walking or passing his hand through the beam, which displaces and/or greatly attenuates the echo target signal so as to lose coincidence with the narrow receiver gating pulse and thereby sound the second audio beep signal. After about three-fourths of the calibrate operation, more precisely at 25.4 seconds in the exemplary embodiment being considered, the first audio beep signal is again sounded indicating the calibrate mode is coming to an end. The remainder of the calibrate mode allows adequate time for final calibration when no further operator intrusion should be performed and for the operator to vacate the protected area.

Figure 5:
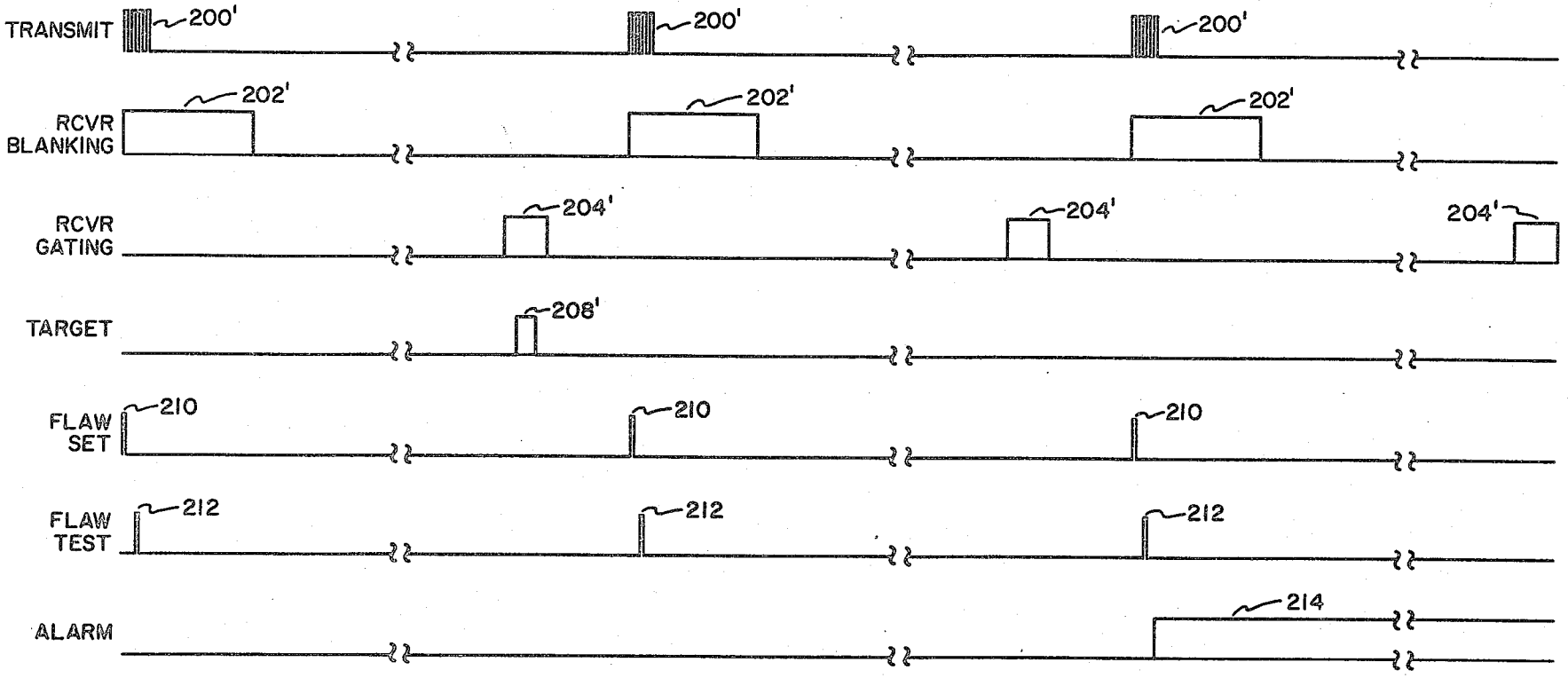
FIG. 5 is a further timing diagram useful in describing operation of the present system.

Upon conclusion of the calibrate mode, the Timing output 128 from binary counter 76 provides a 34 second signal to mode counter 78 which increments the system to the arm mode. Operation in the arm mode comprises successive arm cycles, each of 66.1 milliseconds duration that correspond to the test cycles of the calibrate mode. Accordingly, at the initiation of each arm cycle of the arm mode there is generated a transmit signal and a receiver blanking pulse, shown by waveforms 200[1] and 202[1] in the arm mode timing diagram of FIG. 5. The narrow receiver gating pulse is subsequently generated, illustrated by waveform 204[1], which enables the gated AGC amplifier network 92. Upon the ultrasonic signal being reflected from primary target surface 24 and received without being obstructed or substantially attenuated, it will be amplified, detected and threshold compared to provide a target signal that appears substantially in coincidence with the receiver gating pulse. The target signal is shown by waveform 208[1] in FIG. 5. The target signal appearing at Target output 158 and the receiver gating pulse on Receiver Gating output 172 are combined in flaw tester network 88 and when in substantial coincidence act to prevent a flaw signal from being generated at Flaw output 130. Thus, no audible alarm signal will be sounded for so long as the transmitted ultrasonic signal continues to be reflected from target surface 24 without interference or substantial attenuation.

Upon the occurrence of an intrusion within the protected area which interferes with or substantially attenuates the transmitted ultrasonic signal so that there is no echo target signal that coincides with the receiver gating pulse, no detected target signal will appear at Target output 158. For this condition, and in response to a flaw set and flaw test signal shown by waveforms 210 and 212, respectively, a flaw signal is generated at Flaw output 130 which is coupled to mode counter 78 for transitioning the system to the alarm mode and enabling Alarm output 134 which is applied to alarm network 86 and results in a high volume audible alarm signal being generated by horn 148. The alarm signal is shown by waveform 214 in FIG. 5. This audible alarm signal will persist for a period of four and one-half minutes at the end of which Timing output 128 provides a 4.5 minute signal to mode counter 78 for incrementing the system back to the calibrate mode. The previously described calibration process will then be repeated, at the end of which the system is again placed in the arm mode.

It is noted that the described receiver gating action, in addition to being a fundamental step in the system operation, serves to substantially reduce the amount of power utilized by the system apparatus and prolong battery life. It also serves to reduce the potential for false alarm during the arm mode.

In the event that the system remains in the arm mode for a prolonged period of time, i.e., where no intrusion occurs, Timing output 128 applies a periodically occurring signal to recalibrate network 90 which signal is combined with an arm signal on Arm output 129 from mode counter network 78 so as to generate a recalibrate signal on Recalibrate output 174. The recalibrate signal is in turn coupled to the mode counter network for generating a signal on Calibrate-Recalibrate output 138 that is coupled to ROM network 80 for causing the system to be periodically recalibrated through a recalibrate period that is composed of a single sample and test cycle. In the present system, recalibration is performed every four and one-half minutes which acts to renew the reference range stored within RAM network 82 and insures that the system will at all times be accurately calibrated in the presence of ambient changes which can cause significant variation in acoustical energy propagation velocity.

The system is turned off or disarmed by depressing buttons 106, 108 and 110 in proper sequence. If it is assumed that the proper sequence is in this stated numerical order, then the sequential actuation of buttons 106, 108 and 110 will successively increment the keyboard logic network 70 into its states B, C and WAIT, which returns Low Power output 114 to a binary 0 and where it will once again remain until a subsequent operation. Should the off buttons be depressed in an incorrect sequence or should the bad key button 112 be depressed, Bad Key output 116 supplies a signal to mode counter network 78 which acts to cause the audible alarm to be sounded.

The components of black diagram 3 are shown in greater detail for more complete understanding of the invention in FIGS. 6 through 14. In FIG. 6A is illustrated construction of the keyboard logic network 70 which includes a two stage flip flop circuit 240 which is arranged to operate as a gray code counter having outputs $Q_1$, $\overline{Q}_1$, $Q_2$ and $\overline{Q}_2$, a clock input Ck and a reset input R. In accordance with logic symbol convention, a plain symbol such as $\overline{Q}$ represents a binary 1 and a symbol with a bar such as Q represents a binary 0. Thus, as shown in the logic table of FIG. 6B, $Q_1$, $\overline{Q}_2$ outputs from counter 240 of 1,0 correspond to the WAIT state; $Q_1$, $Q_2$ (1,1) correspond to the A state; $\overline{Q}_1$, $Q_2$ (0,1) correspond to the B state; and $\overline{Q}_1$, $\overline{Q}_2$ (0,0) correspond to the C state. Inputs supplied to Ck act to increment the counter in the sequence of the gray code and inputs supplied to reset input R act to reset the counter to the A state. Network 70 in addition includes two groups of AND gates, the first group comprising gates 242, 244, 246 and 248 which operate to provide incrementing of the counter 240 in response to a correct actuation of the various keyboard push buttons. The second group comprises gates 250, 252, 254, 256 and 258 which operate to reset the counter 240 in response to an incorrect actuation of the push buttons. Further, it is seen that a source of supply voltage $V_1$ is coupled to the input of each of push button keys 102 through 112, which are schematically illustrated as single pole, double throw mechanical switches, although for purposes of the invention any one of numerous conventional touch responsive switch constructions may be employed for switching $V_1$ to the normally grounded switch outputs. These outputs, other than previously identified Instant output 140 and Delay output 142, are identified for keys 106, 108, 110 and 112 as 1st, 2nd, 3rd and Bad, respectively.

To inputs of gate 242 are applied signals $Q_1$, $\overline{Q}_2$ from counter 240 and the output from an OR gate 260 to which Instant output 140 and Delay output 142 are applied as inputs. Gate 242 hereby provides an output when the keyboard is in the WAIT state and either the on-instant or on-delay push button is depressed, which output is coupled as an input to a further OR gate 262. The output of gate 262 is coupled to input Ck for incrementing the count of counter 240, in this instance, from the WAIT state to the A state where it will remain until the system is to be turned off. To the inputs of gate 244 are applied signals $Q_1$, $Q_2$, 1st, $\overline{2nd}$ and $\overline{3rd}$ which provide an output when the keyboard is in the A state and off button 106 is depressed and not any other buttons, this output being coupled as an input to OR gate 262 for providing stepping of counter 240 into the B state. To the inputs of gate 246 are applied signals $\overline{Q}_1$, $Q_2$, 2nd, $\overline{1st}$ and $\overline{3rd}$ for providing an output from gate 246 when the keyboard is in the B state and push button 108 is depressed and no other, this output being applied to OR gate 262 for incrementing counter 240 to the C state. To the inputs of gate 248 are applied signals $\overline{Q}_1$, $\overline{Q}_2$, 3rd and $\overline{1st}$ and $\overline{2nd}$ for providing an output from gate 248 when the keyboard is in the C state and push button 110 is depressed and no other, the output from gate 248 being coupled to OR gate 262 for incrementing counter 240 once again to the WAIT state.

To the inputs of gate 250 are applied signals $Q_2$ and 3rd, which provide an output from gate 250 when the keyboard is in the A or B state and push button 110 is depressed, this output being coupled as an input to OR gate 264 for maintaining or resetting counter 240 in the A state and for applying an output to Bad Key output 116 which acts to cause the sounding of the high volume audio alarm as previously discussed. To the inputs of gate 252 are applied signals $\overline{Q}_1$, $Q_2$, 1st and 2nd which provide an output from rate 252 when the keyboard is in the B state and buttons 106 and 108 are simultaneously depressed, this output being coupled to gate 264 for resetting counter 240 to the A state and for supplying an output to Bad Key output 116. To the inputs of gate 254 are applied signals $Q_1$, $Q_2$ and 2nd which provide an output from gate 254 when the keyboard is is the A state and push button 108 is incorrectly depressed. To the inputs of gate 256 are applied signals $\overline{Q}_1$, $\overline{Q}_2$ and 1st for providing output from gate 256 when the keyboard is in the C state and push button 106 is incorrectly depressed. Finally, to the inputs of gate 258 are applied signals $\overline{Q}_1$, $\overline{Q}_2$, 2nd, 3rd and $\overline{1st}$ for providing an output from gate 258 when the keyboard is in the C state and push bottons 108 and 110 are simultaneously depressed and push button 106 is not depressed. Outputs from gates 254, 256 and 258, like the outputs from gates 250 and 252, are each coupled to the input of OR gate 264 for resetting the counter 240 to the A state and applying an output to the Bad Key output 116.

In addition, keyboard logic network 70 includes AND gate 266 and an inverter network 270, $Q_1$ and $\overline{Q}_2$ being applied to the inputs of gate 266, the output of which is coupled through inverter 270 for providing therefrom Low Power output 114, that is a binary 0 when the keyboard network is in the WAIT state and a binary 1 when the keyboard is in any of the other three states.

In FIG. 7 is a more detailed illustration of the oscillation network 72 and binary counters 74 and 76. The oscillator network comprises a Schmidt trigger circuit 280 arranged to function as an inverter in a conventional circuit configuration. One terminal of circuit 280 is coupled through a series limiting resistor 282 to a feedback arrangement including capacitors 284 and 286 and inductor 288, the output being coupled through an amplifier stage 290 from which the oscillator output 152 is taken. This output, which is further identified as $X_o$, is also applied as the input to 12 stage binary counter 74. Counter 74 has an output from each of its stages identified respectively as $X_1$ through $X_{12}$ corresponding to Counter output 153 of FIG. 3. Output $X_{12}$ also is applied as the input to the second 12 stage binary counter 76, the stages of which provide outputs $X_{13}$ through $X_{24}$, respectively, corresponding to Timing output 128 of FIG. 3. It will be subsequently described in greater detail how outputs $X_0$ through $X_{12}$ provide several different counting functions and outputs $X_{13}$ through $X_{24}$ provide several different timing functions in the system operation when enabled by Low Power output 114.

Figures 8, 10:
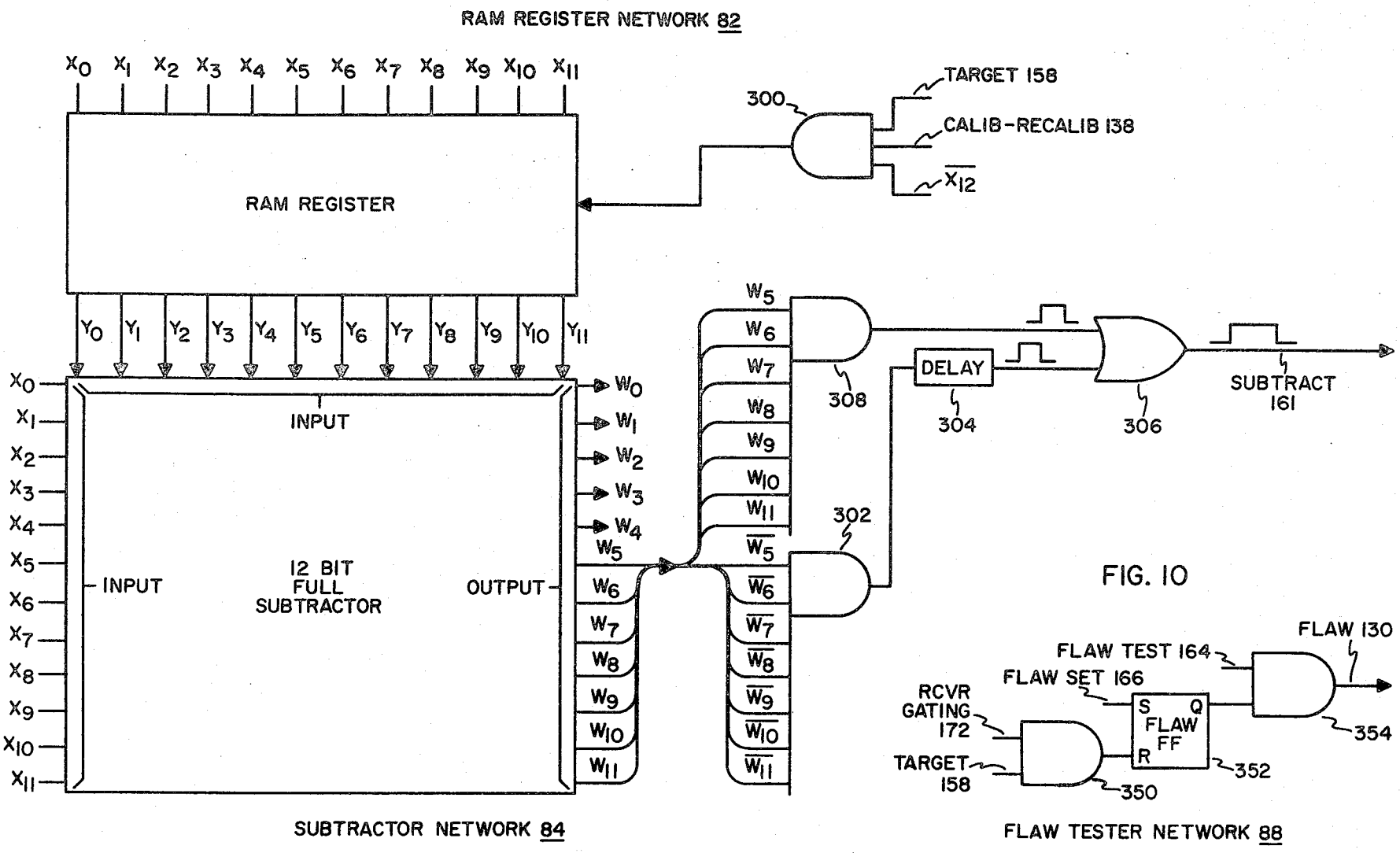
FIG. 8 is a schematic logic diagram of the register and subtractor networks of the present system.
FIG. 10 is a schematic logic diagram of the flaw tester network of the present system.

Referring now to FIG. 8 there is a more detailed illustration of the RAM register network 82 and the subtractor network 84, both of which are in themselves conventional components. Network 82 includes a 12 stage register to the stages of which outputs $X_0$ through $X_{11}$ from oscillator network 72 and Counter 74 are applied as inputs. Outputs $Y_0$ through $Y_{11}$ are taken from the register in response to a latching signal from an AND gate 300 to which Target output 158, Calibrate-Recalibrate output 138 and $\overline{X}_{12}$ are applied as inputs. Enabling signals at outputs 138 and $\overline{X}_{12}$ correspond to the sample cycle duration of the calibrate (or recalibrate) mode. Accordingly, in its operation the register continuously reads the count in the first 11 stages of binary counter 74, storing the count corresponding to the instant in which the latching signal is applied, this instant being determined by the leading edge of the detected target signal of Target output 158 during a sample cycle of the calibrate mode.

Outputs $X_0$ through $X_{11}$ are applied to a first set of inputs of 12 bit full subtractor network 84 and outputs $Y_0$ through $Y_{11}$ are applied to a second set of inputs of the subtractor. A difference quantity is obtained at outputs $W_0$ through $W_{11}$, this output being the difference of the stored count Y in the RAM register and the continuous count X in counter 74. Outputs $\overline{W}_5$ through $\overline{W}_{11}$ are applied to an AND gate 302, the output of which is a pulse about 0.5 milliseconds wide, coupled through a delay circuit 304, which may comprise a flip flop component, as a first input to an OR gate 306. Outputs $W_5$ through $W_{11}$ are coupled to an AND gate 308, the output of which is also a pulse about 0.5 milliseconds wide, immediately following the pulse from AND gate 302, this pulse being applied as a second input to gate 306. Delay circuit 304 serves to provide slight overlap in the pulses at the input to gate 306 so as to provide at its output the Subtract output 161 in the form of a single pulse approximately 1 millisecond in width.

Figure 9:
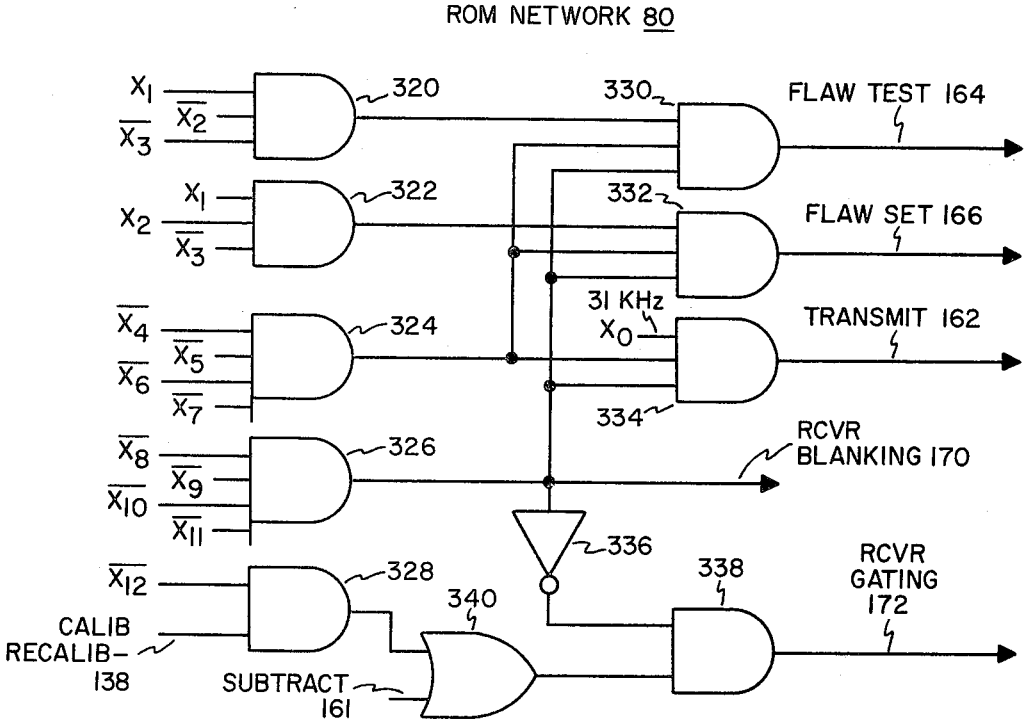
FIG. 9 is a schematic logic diagram of the ROM network of the present system.

In FIG. 9 there is illustrated construction of the ROM network 80 which comprises a first group of AND gates 320, 322, 324, 326 and 328, and a second group of AND gates 330, 332 and 334. Counter outputs $X_1$, $\overline{X}_2$ and $\overline{X}_3$ are applied as inputs to gate 320, the output of which is coupled as a first input to gate 330. $X_1$, $X_2$ and $\overline{X}_3$ are coupled as inputs to gate 322, the output of which is applied as a first input to gate 332. $\overline{X}_4$, $\overline{X}_5$, $\overline{X}_6$ and $\overline{X}_7$ are applied as inputs to gate 324. The output of gate 324 is coupled as a second input to gates 330, 332 and 334, the first input to gate 334 being the oscillator output $X_0$. $\overline{X}_8$, $\overline{X}_9$, $\overline{X}_{10}$ and $\overline{X}_{11}$ are applied as inputs to gate 326, the output of which is applied as a third input to gates 330, 332 and 334. Gate 330 generates a flaw test signal at Flaw Test output 164 during the first count of every 2048 counts of counter 74, which corresponds to a period of 66.1 milliseconds, the length of each of the sample, test and arm cycles. Gate 332 generates a flaw set signal at Flaw Set output 166 during the third count of every 2048 counts of counter 74. Gate 334 generates at Transmit output 162 a transmit signal comprising eight pulses of the oscillator signal during the first eight counts of every 2048 counts of counter 74.

The output of gate 326, which has been referred to as the Receiver Blanking output 170 coupled to alarm network 86, is also coupled through an inverter 336 to the first input of a further AND gate 338. Counter output $\overline{X}_{12}$ and Calibrate-Recalibrate output 138 are applied as inputs to gate 328, the output of which is coupled as a first input to an OR gate 340. Subtract output 161 is coupled as a second input to gate 340, the output of which is applied as a second input to gate 338 from which Receiver Gating output 172 is taken. It may be seen from the logic circuitry that an enabling receiver gating signal is generated at times other than receiver blanking periods when either a sampling cycle or subtract signal is present.

In FIG. 10 is a more detailed illustration of the flaw tester network 88 which comprises a first AND gate 350, a flaw flip flop circuit 352 and a second AND gate 354. Target output 158 and Receiver Gating output 172 are applied to inputs of gate 250, the output thereof being coupled to a reset input of flip flop 352, the set input of which has coupled to it Flaw Set output 166. The output of flip flop 352 together with Flaw Test output 164 are coupled to the input of gate 354 for providing Flaw output 130. With a detected target signal present at Target output 158 that is in coincidence with the narrow receiver gating pulse at Receiver Gating output 172, the flaw flip flop is reset having been set at the beginning of each cycle of the arm mode or each test cycle of the calibrate mode, as the case may be. With the flaw flip flop reset, no output appears from flip flop 352 and, therefore, no signal is present at the Flaw output 130 for causing the sounding of the audible alarm. On the other hand, if gate 350 is not actuated by the presence of a detected target signal, the flaw flip flop remains set to provide an output therefrom, and upon application of the flaw test signal an enabling signal occurs at the Flaw output 130 to sound the audible alarm.

Figure 11:
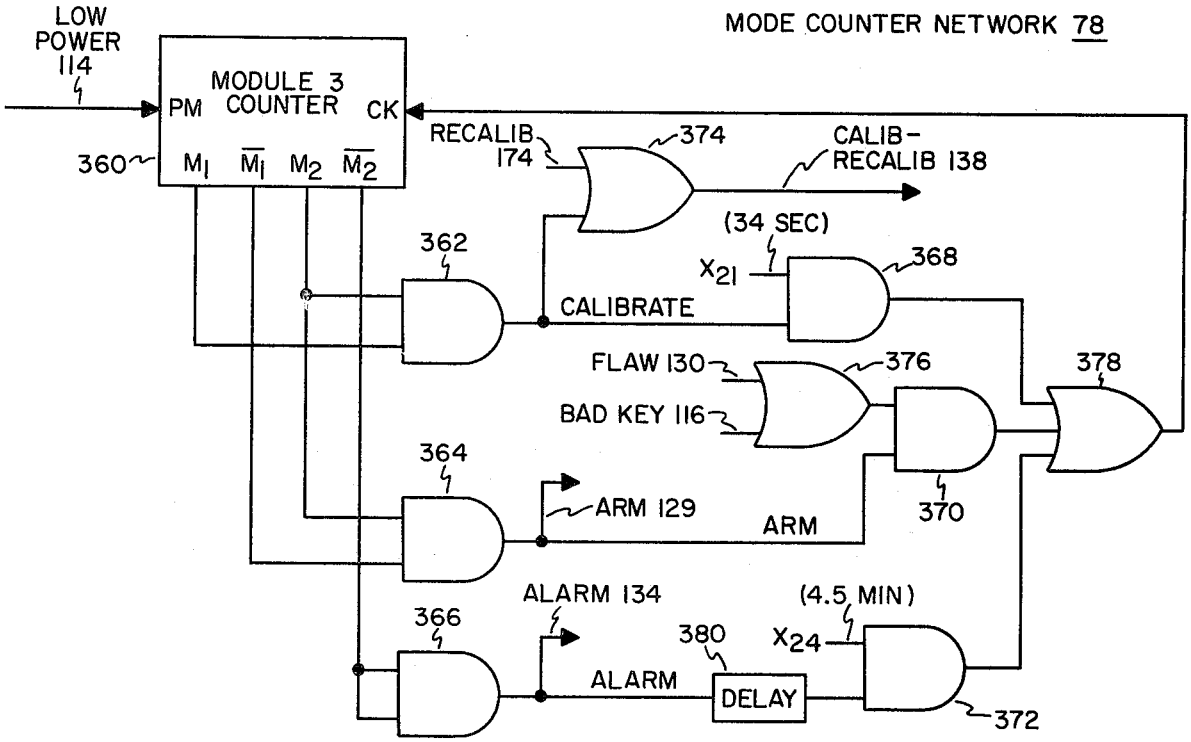
FIG. 11 is a schematic logic diagram of the mode counter network of the present system.

In FIG. 11 is illustrated construction of the mode counter network 78 which includes a pair of flip flops arranged as a modulo three counter 360 having outputs $M_1$, $\overline{M}_1$, $M_2$ and $\overline{M}_2$ and a clock input Ck for incrementing the counter. There is also a power terminal Pm to which Receiver Power output 114 is applied. Mode counter network 78 also includes a first group of AND gates 362, 364 and 366, a second group of AND gates 368, 370 and 372, OR gates 374, 376 and 378 and a delay circuit 380, which may comprise a flip flop component. Outputs $M_1$ and $M_2$ to which mode counter 78 is set by Receiver Power output 114 are coupled to the input of gate 362 for providing an output therefrom representing the calibrate mode and being coupled as an input to gate 368 together with a 34 second input which is taken from output $X_{21}$ of Counter 76. The output of gate 368 is coupled as an input to gate 378, the output of which is coupled to Ck and serves to increment the counter 360 to the succeeding mode. In this example, after 34 seconds in the calibrate mode the counter is incremented to the arm mode. The output of gate 362 is also coupled to gate 374 together with Recalibrate output 174 for providing Calibrate-Recalibrate output 138.

Upon incrementing counter 360 to the arm mode, signals appear at outputs $\overline{M}_1$ and $M_2$ which are coupled to the input of gate 364. The output of gate 364, representing the arm mode, provides Arm output 129 and is coupled as a first input to gate 370. The output of gate 376 to which Flaw output 130 and Bad Key output 116 are applied as inputs, is coupled as a second input to gate 370 whose output is coupled to the input of gate 378. Accordingly, when in the arm mode, with either the Flaw output or Bad Key output enabled, an output is generated by gate 370 for incrementing counter 360 to the alarm mode.

Upon incrementing counter 360 to the alarm mode, a signal appears at output $\overline{M}_2$ which is coupled through gate 366 to provide an output representing the alarm mode. This output provides Alarm output 134 which is coupled to alarm network 86 to contributing to the sounding of the audible alarm, as previously considered, and is also coupled to the reset terminal of binary counter 76 for resetting this counter. The output of gate 366 is further coupled through a short delay circuit 380, providing typically a delay of 60 microseconds, as a first input to gate 372. A $4\frac{1}{2}$ minute input taken from output $X_{24}$ of counter 76 is applied as a second input to gate 372, the output of which is coupled to the input of gate 378. Thus, immediately upon the system being transitioned into the alarm mode for sounding the audible alarm, counter 76 is reset and after $4\frac{1}{2}$ minutes as determined by its count, the system is transitioned back to the calibrate mode serving to terminate the audible alarm and entering a new sequence of operation.

Figure 12:
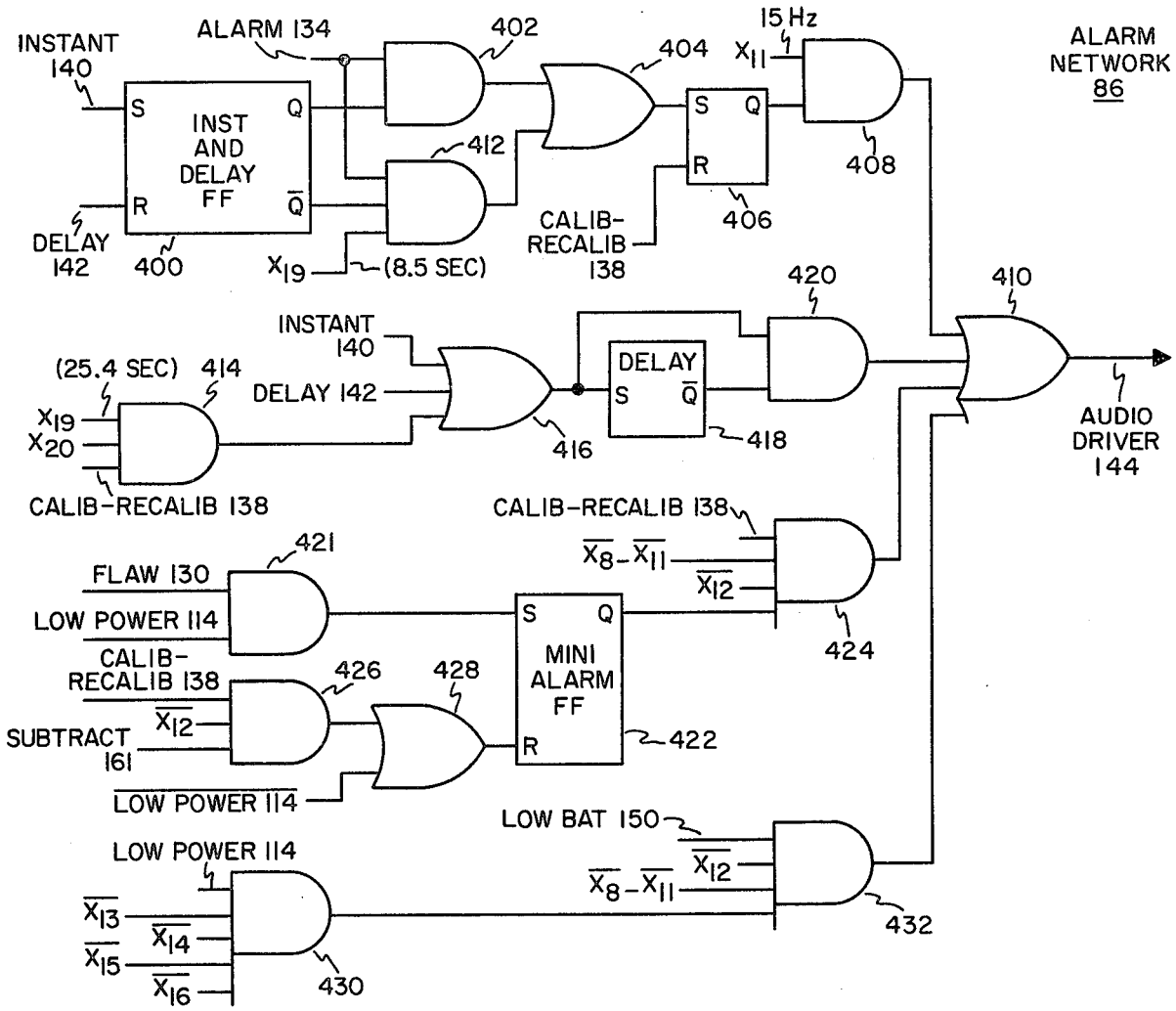
FIG. 12 is a schematic logic diagram of the alarm network of the present system.

In FIG. 12 is illustrated construction of the alarm network 86 which includes a flip flop circuit 400 to which the Instant Output 140 is applied as a first input and Delay output 142 is applied as a second input. Application of an instant signal generates a sustained first output from flip flop 400 that is coupled to an AND gate 402 together with the alarm signal at Alarm output 134. The output of gate 402 is coupled to an OR gate 404 whose output is applied to the set input of a further flip flop circuit 406. The output of this flip flop is applied as a first input to AND gate 408 together with a 15 Hz tone taken from $X_{11}$, the output of gate 408 being coupled to an OR gate 410 from the output of which is taken Audio Driver output 144 for sounding an audible alarm. Thus, in accordance with the logic circuitry, with the on-instant button having been depressed, which is held by flip flop 400, the occurrence of an alarm signal will actuate gates 402, 404, flip flop 406 and gate 408 to pass a 15 Hz modulating tone through gate 410 to Audio Driver output 144. Calibrate-Recalibrate output 138 is applied to a set input of flip flop 406 for resetting this circuit and terminating the audible alarm signal.

Application of a delay signal to flip flop 400 generates a sustained second output that is coupled to AND gate 412 together with Alarm output 134 and an 8.5 second signal from $X_{19}$. The output of gate 412 is coupled through OR gate 404 to the set input of flip flop 406 for causing sounding of the audible alarm with an 8.5 second delay after the alarm signal is applied by virtue of the $X_{19}$ input to gate 412.

For generating the first beep signal when starting the system and after about twenty-five seconds of the calibrate mode, a 25.4 second signal from $X_{19}$ and $X_{20}$ is applied to AND gate 414 together with Calibrate-Recalibrate output 138, the output of which is coupled to OR gate 416 with Instant output 140 and Delay output 142. The output of gate 416 is coupled to the input of flip flop circuit 418 and directly to one input of AND gate 420, the other input of which is taken from the $\overline{Q}$ output of flip flop 418. Flip flop 418 provides a short delay, in the present example 16.5 milliseconds, so that there is generated at the output of gate 420 a single pulse signal of a width corresponding to this delay that is coupled through gate 410 to Audio Driver output 144 for providing a short acoustical energy burst from horn 148.

For generating the second beep signal during calibration testing, Flaw output 130 and Low Power output 114 are applied to AND gate 421, the output of which is coupled to set input of a flip flop 422 for providing an input to AND gate 424. Also coupled to gate 424 are outputs $\overline{X}_8$ through $\overline{X}_{11}$, which is provided by Receiver Blanking output 170, $\overline{X}_{12}$ and Calibrate-Recalibrate output 138. In accordance with the logic circuitry, responsive to a flaw occurring during a calibrate mode, $\overline{X}_8$ through $\overline{X}_{12}$ generate a train of pulses from gate 424 with a pulse width determined by $\overline{X}_8$ and a pulse repetition rate determined by $\overline{X}_{12}$. In this example, there are generated pulses about 4 milliseconds wide every 132 milliseconds which when applied through audio horn driver 94 to horn 148, create the second beep signal when the system is not correctly calibrated. This signal is terminated by the application of the Calibrate-Recalibrate output 138, $\overline{X}_{12}$ and Subtract output 161, which logically represent a restored calibration, to AND gate 426, the output of which is applied to OR gate 428 to which a low power signal is also applied, the output of gate 428 being coupled to the reset input of flip flop 422 for removing the output signal therefrom.

For generating the third beep signal in response to a low battery voltage, Low Power output 114 and $\overline{X}_{13}$ through $\overline{X}_{16}$ are applied to AND gate 430, the output of which is coupled to AND gate 432 together with Low Battery output 150 and $\overline{X}_8$ through $\overline{X}_{12}$. Thus, in response to the battery voltage falling below a predetermined level required for satisfactory operation, the logic circuitry provides a train of pulses generated from gate 432 with a pulse width determined by $\overline{X}_8$ and pulse repetition rate determined by $\overline{X}_{16}$. In this example, there are generated pulses about four milliseconds wide every two seconds, which are applied to energize horn 148 to create the third beep signal indicating the battery voltage to be low.

Figure 13:
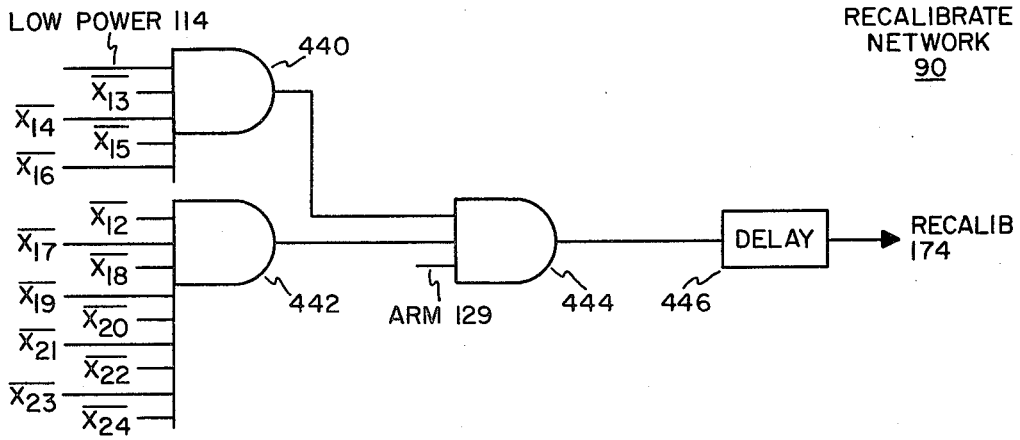
FIG. 13 is a schematic logic diagram of the recalibrate network of the present system.

FIG. 13 illustrates a detailed construction of the recalibrate network 90 which includes AND gates 440, 442, 444 and delay circuit 446 which may comprise a flip flop component. Low Battery output 114 and $\overline{X}_{13}$ through $\overline{X}_{16}$ are applied to the input of gate 440, the output of which is applied as a first input to gate 444. $\overline{X}_{12}$ and $\overline{X}_{17}$ through $\overline{X}_{24}$ are applied to gate 442, the output of which is coupled as a second input to gate 444 together with Arm output 129 coupled as a third input. There is accordingly generated at Recalibrate output 174 a train of pulses with a pulse width determined by $\overline{X}_{12}$ and a pulse repetition rate determined by $\overline{X}_{24}$. In the present example, these pulses are 66.1 milliseconds wide and occur every $4\frac{1}{2}$ minutes for providing recalibration of the system.

Figure 14:
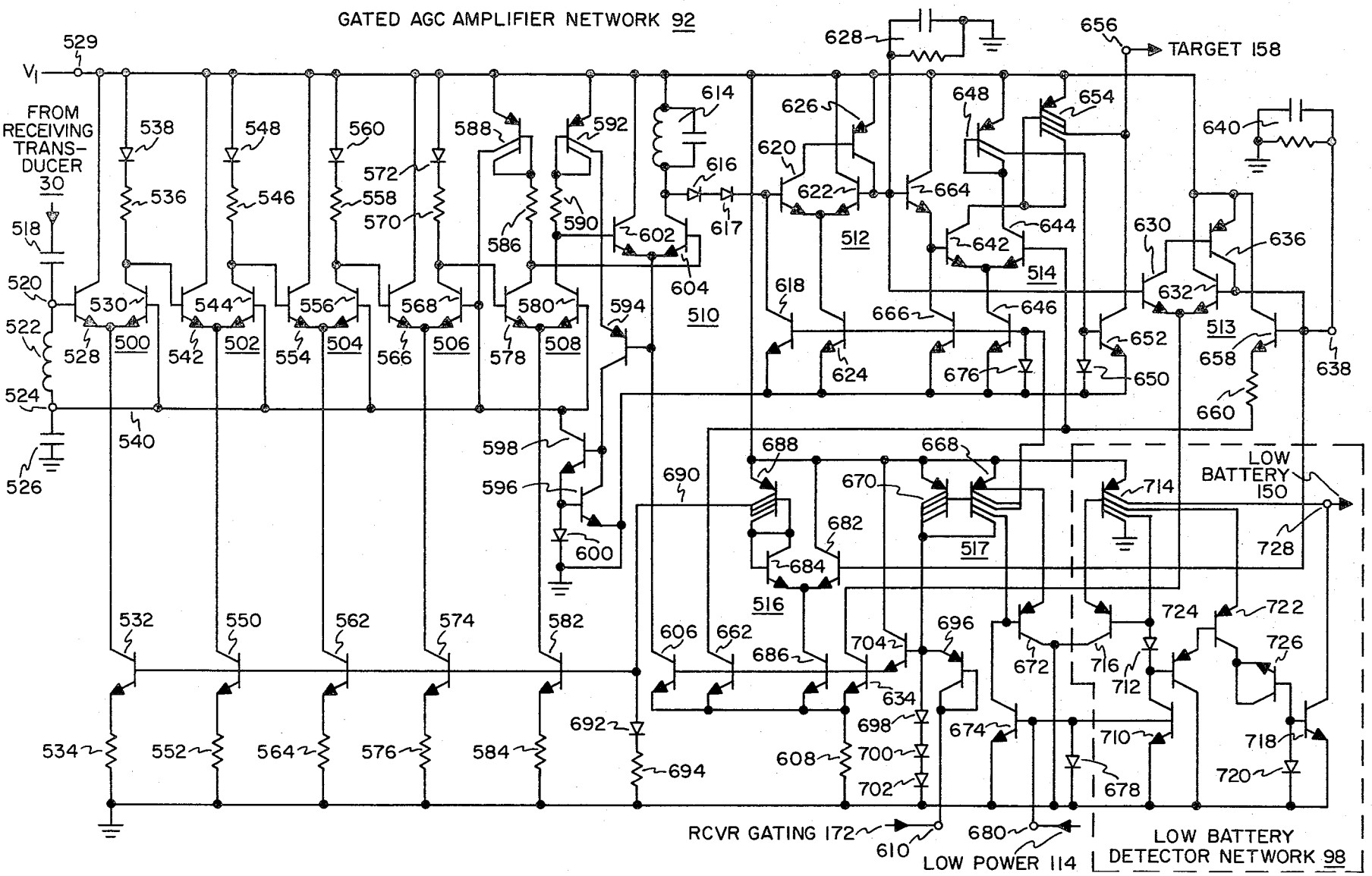
FIG. 14 is a schematic circuit diagram of the gated AGC amplifier and low battery detector networks of the present system.

Referring now to FIG. 14 there is illustrated a schematic circuit diagram of the receiver gated AGC amplifier network 92 and low battery detector network 98. Network 92 comprises five stages of controllable gain 500 through 508 and a constant gain stage 510, an envelope detector 512, an AGC detector 513, a threshold circuit 514, an AGC control circuit 516 and a bias current network 517. The echo target signals from receiving transducer 30 are connected through an ac coupling capacitor 518 to a first input terminal 520 and through a dc coupling inductor 522 to a second input terminal 524. An ac coupling capacitor 526, across which is developed a stabilized dc bias voltage for maintaining a balanced current within differentially connected transistors of each controllable gain amplifier stage, is connected between terminal 524 and ground. Input stage 500 comprises a pair of differentially connected NPN transistors 528 and 530, the emitters of which are joined and connected to the collector of a current source NPN transistor 532. The emitter of transistor 532 is connected through a current determining resistor 534 to ground. The collector of the first differentially connected transistor 528 is coupled directly to a terminal 529 which is coupled to supply voltage $V_1$, and the collector of the second differentially connected transistor 530 is coupled through the serial connection of a resistor 536 and forward poled diode to terminal 529. The base of transistor 530 is connected to a dc bus 540 which is coupled to input terminal 524 and also to the bases of the second differentially connected transistors of stage 502 through 508. The collector of transistor 530 provides a single ended output from the first stage 500. Current source transistor 532 is AGC and gate controlled, as are the current source transistors of the remaining gain controlled stages.

Stage 502 includes first and second differentially connected NPN transistors 542 and 544, respectively, the output from stage 500 being connected to the base of transistor 542 for applying an input to the second stage. The collector of transistor 542 is coupled directly to terminal 529 and the collector of transistor 544 is coupled through the serial connection of a resistor 546 and a forward poled diode 548 to terminal 529. The collector of transistor 544 provides a single ended output connection to the succeeding stage 504. Transistors 542 and 544, having their emitters joined, are supplied with current by a current source NPN transistor 550 whose emitter is connected through a current determining resistor 552 to ground.

Stage 504 includes a pair of differentially connected NPN transistors 554 and 556, the serial connection of resistor 558 and diode 560 in the collector circuit of transistor 556, a current source NPN transistor 562 and a current determining resistor 564. Stage 506 includes a pair of differentially connected NPN transistors 566 and 568, the serial connection of a resistor 570 and diode 572 in the collector circuit of transistor 568, a current source NPN transistor 574 and a current determining resistor 576. The transistor, resistor and diode components of stages 504 and 506 are in identical circuit configuration as described with respect to stages 500 and 502 and are of matching characteristics with corresponding components of these stages and also with corresponding components of output stage 508. A single ended output is taken from the collector of transistor 556 and coupled to the base of transistor 566 for supplying an input to stage 506, and a single ended output is taken from the collector of transistor 568 and coupled to the base of the first differentially connected NPN transistor 578 of output stage 508 for supplying the input to this stage.

Output stage 508 includes a second differentially connected NPN transistor 580, transistors 578 and 580 being connected in a balanced circuit configuration and providing a differential output to the final amplification stage 510. The emitters of transistors 578 and 580 are joined and coupled to the collector of a current source NPN transistor 582, the emitter of which is connected through a current determining resistor 584 to ground. The collector of transistor 578 is connected through a resistor 586 to the junction of the base and a first collector of a current mirror dual collector PNP transistor 588, the emitter of which is connected to terminal 529. The second collector of transistor 588 is connected to bus 540. Transistor 588, which provides a diode connection in the collector circuit of transistor 578, is constructed so as to generate substantially equal current flow in the first and second collectors thereof so that current flowing from its second collector, which is the charge current for capacitor 526, is equal to current in the collector circuit of transistor 578.

The collector of transistor 580 is connected through a resistor 590 to the junction of the base and a first collector of a second current mirror dual collector PNP transistor 592, the emitter of which is connected to terminal 529. The second collector of transistor 592 is coupled to the emitter of a cascade connected PNP transistor 594. Similar to transistor 588, transistor 592 provides a diode connection in the collector circuit of transistor 580 and is constructed to generate substantially equal currents in its first and second collectors so that current flowing in transistor 594 is substantially equal to current in the collector circuit of transistor 580.

The collector of transistor 594 is coupled to the collector of an NPN transistor 596 and to the base of a further NPN transistor 598 which is also of cascade connection. The emitter of transistor 596 is coupled to ground, and its base is coupled through a forward poled diode 600 to ground and to the emitter of transistor 598, the collector of which is connected to bus 540. Transistor 596 and 598 are arranged to provide a further current mirror operation whereby the current flowing in transistor 594 is substantially equal to current flowing in transistor 598, which is the discharge current for capacitor 526. The capacitor charge and discharge currents are made equal to each other for the condition in which the collector currents in transistors 578 and 580 are equal, so as to establish a constant dc bias voltage which maintains a balanced current between the differentially connected transistors in the output stage and also in all preceding stages in the presence of an applied signal throughout the gated amplifier operation. This ensures maximum amplifier gain and maximum dynamic range over the entire AGC characteristic. In the present example, there was achieved a dynamic range of 50 db for the amplifier input signal for an amplifier output signal constant to within 3 db.

The output of stage 508 is taken from the collectors of transistors 578 and 580 which are coupled, respectively, to the bases of differentially connected NPN transistors 602 and 604 of final amplifier stage 510. Stage 510 is a conventional circuit of constant gain employed to provide a desired overall amplifier gain while permitting the differentially connected transistors of the controllable gain stages to operate well within their linear regions. The emitters of transistors 602 and 604 are joined and connected to the collector of current source NPN transistor 606, whose emitter is coupled through a current determining resistor 608 to ground. Transistor 606 provides a constant current that is gate controlled "on-off" in response to the Receiver Gating output 172 that is applied to terminal 610, which gating action will be further described. The collector of transistor 602 is coupled directly to terminal 529 and the collector of transistor 604 is coupled to terminal 529 through an LC tuned circuit 614 tuned to the carrier frequency of the received echo target signals, which in the present example is 31 KHz.

The collector of transistor 604 provides the output of final amplifier stage 510 and is coupled through a pair of forward poled diodes 616 and 617 and a current source NPN transistor 618 to ground and to the base of a first differentially connected NPN transistor 620 of envelope detector 512 for supplying an input thereto. Envelope detector 512, which is a conventional circuit, also includes a second differentially connected NPN transistor 622. The joined emitters of transistors 620 and 622 are coupled through a current source NPN transistor 624 to ground. The collector of transistor 620 is coupled to the base of an output PNP transistor 626, whose emitter is coupled to terminal 529. The collector of transistor 626 is coupled through an RC circuit 628 to ground, the RC circuit having a time constant that allows envelope detector 512 to detect the envelope of the amplifier ac signal appearing at the output of final amplifier stage 510.

The envelope detector output is connected to an AGC detector circuit 513 which is of similar circuit configuration to detector 512, including a pair of differentially connected NPN transistors 630 and 632, this connection being from the collector of transistor 626 to the base of transistor 630. The joined emitters of transistors 630 and 632 are coupled to the collector of a current source NPN transistor 634, whose emitter is coupled through current determining resistor 608 to ground. Transistor 634 is gate controlled in response to the receiver gating signal at terminal 610. An output PNP transistor 636 is coupled to terminal 638 which is coupled through a second RC circuit 640 to ground. The AGC detector 513 operates in similar fashion to envelope detector 512, with the time constant assigned to its RC circuit holding the peak voltage of the envelope detected waveform and providing a relatively slow response to downward changes in input signal strength. Accordingly, in conventional manner an AGC voltage is developed across the capacitor of RC circuit 640 that is greater or less than a mean value as a function of input signal strength.

The threshold circuit 514 includes a pair of differentially connected NPN transistors 642 and 644 whose emitters are joined and coupled through a current source NPN transistor 646 to ground. The collector of transistor 644 is coupled to the junction of the base and first collector of a current mirror dual collector PNP transistor 648, whose emitter is coupled to terminal 529. The second collector of transistor 648 is coupled through a forward poled diode to ground, which diode is coupled across the base and emitter of an NPN transistor 652. Transistor 642 has its collector coupled to the junction of the base and first collector of a current mirror four collector PNP transistor 654, whose emitter is connected to terminal 529. The other three collectors of transistor 654 are joined and coupled to the collector of transistor 652 and to terminal 656, from which the detected target signals are taken. A threshold voltage is applied to the base of transistor 644 of the threshold circuit by means of a circuit including an NPN transistor 658 whose collector is coupled to terminal 529, base is coupled to terminal 638 and emitter is coupled through a resistor 660 to the base of transistor 644 and to the collector of a current source NPN transistor 662 having its emitter coupled to current determining resistor 608. The threshold voltage is established below the AGC voltage at terminal 638, by somewhat more than a diode drop, being in the range of 0.8 to 1 volt in the present example. The threshold voltage is compared in the threshold circuit 514 to the voltage at the output of the envelope detector 512 which is applied to transistor 642 by NPN transistor 664, which has its base coupled to the output of envelope detector at the collector of transistor 626, its collector coupled to terminal 529 and its emitter coupled to the base of transistor 642 and to the collector of current source NPN transistor 666 whose emitter is coupled to ground.

The current source transistors 618, 624, 646 and 666 have their bases coupled together and to a bias current circuit 517 which includes current mirror four collector PNP transistor 668 and 670, bias PNP transistor 672, current source NPN transistor 674 and diodes 676 and 678. A terminal 680, to which the Low Power output 114 is applied, is coupled through forward poled diode 678 to ground and to the parallel connected base-emitter junction of transistor 674. The collector of transistor 674 is connected to the second collector of transistor 668 and to the base of transistor 672, whose emitter is joined to the base of transistor 668 and whose collector is coupled to ground. The third and fourth collectors of transistor 668 are joined and connected to the bases of current source transistors 618, et seq. The emitter of transistor 668 is coupled to terminal 529 as is the emitter of transistor 670. The four collectors of transistor 670 are joined to the first collector of transistor 668 and coupled through a diode circuit to ground. In response to a receiver power signal applied to terminal 680, transistors 674, 672, 668 and 670 conduct with the current generated by the joined third and fourth collectors of transistor 668 providing a low bias current in the above noted current source transistors 618, et seq. of the envelope detector and threshold circuits.

During the time the amplifier stages are gated "off", no signal appears at the amplifier output and no signal voltage is applied to the base of transistor 642 in threshold circuit 514. This transistor then does not conduct and transistor 644, with the threshold voltage applied to its base, conducts the current supplied by current source 646. In turn, transistor 648 conducts and the resulting current through diode 650 brings transistor 652 into a saturated conduction which places terminal 656 substantially at ground. When the amplifier stages are gated "on" so as to amplify an echo target signal at the input in accordance with a previously established AGC operation, a pulse voltage from the envelope detector is applied to the base of transistor 642. If the input signal is of sufficient amplitude so that after amplification it exceeds the predetermined threshold voltage, transistor 642 will conduct and transistor 644 becomes nonconducting. This turns off transistors 648 and 652 and causes transistor 654 to conduct so as to place terminal 656 substantially at the supply voltage, which supplies the detected target signal to the digital circuitry.

For automatic gain control, the voltage at terminal 638 is applied to the base of a first differentially connected NPN transistor 682 of an AGC control network 516, which also includes second differentially connected NPN transistor 684. The joined emitters of transistors 682 and 684 are coupled to a current source NPN transistor 686 having its base and emitter joined to the base and emitter, respectively, of current source transistors 606, 662 and 634 so that these transistors all supply the same current. The collector of transistor 682 is coupled directly to terminal 529, and the collector and base of transistor 684 are joined and coupled to the junction of the base and first collector of a four collector current mirror PNP transistor 688, the emitter of which is connected to terminal 529. Thus, transistor 684 is connected as a diode, as is that portion of transistor 688 including its emitter, base and first collector. The remaining three collectors of transistor 688 are joined and coupled to a conductor 690 which is coupled through the serial connection of a forward poled diode 692 and resistor 694 to ground and to each of the bases of the current source transistors 532, 555, 562, 574 and 582 for controlling the gated "on-off" AGC operation of the gain controlled amplifier stages. Transistor 688 is constructed so as to generate equal current flow in each of its collectors so that the AGC current supplied to conductor 690 is three times the current flowing in the collector circuit of transistor 684.

For gate control operation, terminal 610, to which the receiver gating signal is applied, is connected to the collector base junction of a diode connected PNP transistor 696. The emitter of transistor 696 is through a triplet of serially connected forward conduction poled diodes 698, 700 and 702 to ground and to the base of an NPN transistor 704 whose collector is coupled to terminal 529 and whose emitter is coupled to the bases of current source transistors 606, 634, 662 and 686. The diode triplet and transistor 704 provide a voltage bias for operation of the current source transistors. The diode triplet is further coupled to the joined collectors of transistor 670 and a single collector of transistor 667 to complete the current path for these transistors.

In AGC operation, current flowing in transistors 684 and 688, and hence the trebled current supplied to conductor 690, is inversely related to the AGC voltage at terminal 638 that is applied to the base of transistor 682. Thus, if the AGC voltage should exceed its mean value in response to relatively strong input signals, current supplied to transistor 682 is increased and is decreased to transistor 684 and therefore to conductor 690. This serves to lower the current in diode 692 and resistor 694 and accordingly reduces the voltage at the bases of current source transistors 532 et seq. for reducing the current therein. Reducing the current in the current sources accordingly decreases the gm or gain of each gain controlled stage as a function of the AGC voltage. Conversely, if the AGC voltage should fall below its mean value in response to relatively weak input signals, current applied to transistor 682 is decreased and is increased to conductor 690. This serves to increase the current in the current source transistors so as to increase the gm or gain of each gain controlled stage as a function of the AGC voltage.

Gating "on" and "off" of the amplifier network is accomplished through control of current source transistor 606, 662, 686 and 634 by the receiver gating signal applied to terminal 610. Thus, the amplifier is gated "on" with an enabling voltage applied through transistors 696 and 704 to the base of transistors 606, et seq. for placing these transistors in their conducting state and providing an operation of the circuit as above described. The amplifier network is gated "off" with a disabling voltage applied to the base of transistors 606, et seq. which places these transistors in their nonconducting state. With respect to transistor 686, specifically, by making it nonconducting, no current can flow into conductor 690 and the current source transistors of the gain controlled stages are also made nonconducting. During the gated "off" periods, reverse biased semiconductor junctions are presented to the bias voltage across capacitor 526 and, hence, the amount of discharge of capacitor 526 between gated "on" periods is negligible.

Considering the gated AGC and threshold operation of the amplifier network in the present intrusion alarm system, and refering once more to the timing diagram of FIG. 4, during a sample cycle of a system calibration, the first in time echo target signal establishes a preliminary AGC and threshold voltage as a function of its signal strength and a corresponding target signal 206 appears at terminal 656 for application to the digital circuitry. In this example, the second in time echo target signal is presumed to have a signal strength great enough, after amplification, to exceed the initially established threshold voltage, and a corresponding target signal 208 is supplied to the digital circuitry. As has been described, the system operates to respond to the last strong target signal to determine positioning of the range gate. Thus, during the test cycle of the calibrate mode and during the arm mode, only the second echo target signal is amplified, and it is the strength of this reference signal that establishes an operative AGC and threshold voltage. Since the amplifier network is designed to exhibit a slow AGC response, in the event of an absence or substantial attenuation of the reference echo target signal, no enabling target signal will appear at terminal 656. However, the slow AGC response will allow slow changes in signal strength of succeeding reference echo target signals, such as may be due to natural environmental causes, by virtue of automatic adjustment of the AGC and threshold voltages. It is also noted that by establishing the threshold voltage slightly below the AGC voltage, small instantaneous variations in signal strength of the reference echo target signal that may occur, such as due to a noisey condition, will continue to exceed the threshold voltage so as to be readily accommodated by the amplifier.

A further description of the portions of the amplifier network 92 may be found in Application for U.S. Letters Patent entitled, "Gated AGC Amplifier With DC Feedback", R. J. McFadyen, Ser. No. 93,098 filed concurrently with and of the same assignee as the present application.

The low battery detector network 98 includes a current source NPN transistor 710 whose base-emitter junction is in parallel with diode 678 and whose collector is coupled through a forward poled diode 712 to the junction of the second collector of current mirror PNP transistor 714 and the base of bias PNP transistor 716. The collector of transistor 716 is coupled to ground and the emitter to the base of transistor 714, whose emitter is coupled to terminal 529. The first collector of transistor 714 is coupled to ground. The fourth collector of transistor 714 is coupled to the collector of a bias NPN transistor 718 whose emitter is connected to ground, and a forward poled diode 720 is coupled between its base and ground. The third collector of transistor 714 is coupled to the emitter of a bias PNP transistor 722, the base of which is coupled to the emitter of bias PNP transistor 724 whose base is coupled to the junction of diode 712 and the collector of transistor 710 and whose collector is coupled to ground. The collector of transistor 722 is coupled to the high voltage end of a zener diode 726, the other end of which is coupled to the junction of diode 720 and the base of transistor 718. A terminal 728, from which the Low Battery output 150 is taken, is connected to the collector of transistor 718.

When the supply voltage at terminal 529 is adequate for proper system operation, a voltage is applied to the high voltage end of zener diode 726 of a magnitude to break it down and thereby complete a current path through diode 720 which maintains transistor 718 conducting and places terminal 728 substantially at ground. When the supply voltage falls below a predetermined level so as to be inadequate for proper operation, the voltage applied to zener diode is of insufficient magnitude to cause breakdown and the current to diode 720 is interrupted. This turns off transistor 718 and places a voltage at terminal 728 that is substantially that of the supply voltage, which is in fact the application of an enabling low battery signal to Low Battery output 150.

While the invention has been described with respect to a specific embodiment thereof for the purpose of clear and complete disclosure, it may be appreciated that ones skilled in the art may make numerous changes and modifications to the disclosed circuit without exceeding the basic teaching provided herein. Accordingly, the appended claims are to be construed as embodying all such changes and modifications that fairly fall within the true scope and meaning of the invention.

What we claim as new and desire to secure as Letters Patent of the United States is:

1. An intrusion alarm system wherein transmitted pulsed signals are reflected by at least one surface including a reference surface within a protected area and the resulting received pulsed signals are employed to provide an indication of an intrusion within said protected area, comprising:

(a) transmitter means for periodically transmitting said transmitted pulsed signals, (b) gate controlled receiver means, responsive to said received pulsed signals, for generating output signals that correspond to said received pulsed signals, (c) first means for calculating the travel time of pulsed signals between said transmitter means and receiver means and for generating first control signals as a function of said travel time of received pulsed signals, (d) second means, responsive to said first control signals, for periodically gating on said receiver means during brief periods that coincide with the calculated arrival of pulsed signals that are reflected by said reference surface, whereby said output signals are generated only upon the gated on operation of said receiver means, and (e) third means, responsive to the output signal state of said receiver means during said brief periods, for generating an alarm signal that is indicative of an intrusion in the absence of said output signals and for preventing the generation of said alarm signal in the presence of said output signals.

2. An intrusion alarm system as in claim 1 wherein said second means generates second control signals and said receiver means includes amplifier means whose operation is gate controlled by the application of said second control signals.

3. An intrusion alarm system as in claim 2 wherein said pulsed signals are each composed of several cycles of ultrasonic acoustical energy having a given duration, and said first means is a first digital circuit for generating said first control signals in the form of narrow electrical pulses of a width greater than said given duration and which coincide with the uninterrupted arrival of received pulse signals reflected by said reference surface.

4. An intrusion alarm system as in claim 3 wherein said first digital circuit comprises a binary counter supplying a continuous count, a storage register supplying a stored count corresponding in time to said travel time and a subtractor network which responds to said continuous and stored counts for providing the difference between said two counts from which said narrow electrical pulses are generated.

5. An intrusion alarm system as in claim 4 that includes mode means for initially placing said system in a calibration mode composed of alternating sample and test cycles within which said system is automatically calibrated to operate with said reference surface and said alarm signal is prevented from being generated, for transitioning said system into an arm mode at the conclusion of said calibration mode and for transitioning said system into an alarm mode within which said alarm signal is generated upon the occurrence of an intrusion during said arm mode.

6. An intrusion alarm system as in claim 5 wherein said mode means generates a calibration signal during said calibration mode and an arm signal during said arm mode.

7. An intrusion alarm system as in claim 6 wherein said second means is a second digital circuit for generating said second control signals in the form of narrow electrical pulses of a first width about equal to the width of said first control signal pulses within test cycles of said calibration mode and within said arm mode, said second means being further responsive to said calibration signal for generating said second control signals in the form of relatively wide electrical pulses of a second width substantially greater than said first width within sample cycles of said calibration mode.

8. An intrusion alarm system as in claim 7 wherein said second digital circuit comprises a plurality of gate components.

9. An intrusion alarm system as in claim 8 wherein said third means is a digital circuit comprising a further plurality of gate components for providing, in the absence of said output signals during said brief periods third control signals that are coupled to said mode means for transitioning said system from said arm mode into said alarm mode.

10. An intrusion alarm system as in claim 9 in which said amplifier means comprises an AGC amplifier network including a threshold circuit exhibiting a threshold voltage level that is a function of the normal signal strength of said received pulsed signals, and means for comparing the amplified pulsed signals with said threshold voltage level for generating said output signals only when said threshold voltage level is exceeded.

11. An intrusion alarm system as in claim 10 which includes means for supplying said threshold circuit with a slowly varying threshold voltage level whereby slow changes in the normal signal strength of said received pulsed signals will cause a corresponding adjustment of said threshold voltage level.

12. An intrusion alarm system as in claim 11 wherein said amplifier network further includes an AGC circuit exhibiting a slowly varying AGC voltage level that is a function of the signal strength of said reference received pulsed signals for controlling the gain of said amplifier network and wherein said threshold voltage level is slightly below said AGC voltage level, whereby small instantaneous changes in the signal strength of said reference received pulsed signals will continue to provide amplified signals that exceed said threshold voltage level.

13. An intrusion alarm system as in claim 12 which includes latching means, responsive to said output signals during sample cycles of said calibration mode, for storing successive counts in said storage register corresponding in time to the travel time of successively received pulsed signals that exceed said threshold voltage level, the last stored count being the count from which said narrow electrical pulses are generated.

14. An intrusion alarm system wherein transmitted pulsed signals are reflected by at least one surface including a reference surface within a protected area and the resulting received pulsed signals are employed to provide an indication of an intrusion within said protected area, comprising:

(a) transmitter means for periodically transmitting said transmitted pulsed signals, (b) receiver means responsive to said received pulsed signals for generating output signals that correspond to said received pulsed signals, (c) first means for calculating the travel time of said received pulsed signals between said transmitter means and said receiver means, (d) second means, responsive to said first means, for periodically enabling said receiver means so as to permit the generation of said output signals only upon the enabling of said receiver means, and (e) third means, responsive to the output signal state of said receiver means during brief periods that coincide with the calculated arrival of received pulsed signals reflected by said reference surface for generating an alarm signal that is indicative of an intrusion in the absence of said output signals.

15. An intrusion alarm system as in claim 14 that includes fourth means for initially placing said system in a calibration mode composed of alternating sample and test cycles within which said system is automatically calibrated to operate with said reference surface and said alarm signal is prevented from being generated, and for subsequently transitioning said system into an arm mode within which said alarm signal is generated upon the occurrence of an intrusion.

16. An intrusion alarm system as in claim 15 which includes fifth means for generating first control signals as a function of the travel time of pulsed signals between said transmitter means and said receiver means when reflected by said reference surface, said second means being responsive to said first control signals within set test cycles of said calibration mode and within said arm mode for enabling said receiver means during said brief periods.

17. An intrusion alarm system as in claim 16 wherein said fourth means generates second control signals to which said second means is further responsive for enabling said receiver means during a substantial portion of said sample cycles for providing a preliminary system calibration which calibration is tested and finalized during said test cycles.

18. An intrusion alarm system as in claim 17 which includes sixth means for generating third control signals to which said fourth means is responsive for periodically placing said system in a recalibration mode composed of a single pair of sample and test cycles.

19. An intrusion alarm system as in claim 18 which includes digitally encoded switch means for terminating the generation of said alarm signal when properly actuated in accordance with a previously entered code for causing the generation of said alarm signal when improperly actuated.

* * * * *